US009158232B2

(12) United States Patent
Yoshii et al.

(10) Patent No.: US 9,158,232 B2
(45) Date of Patent: Oct. 13, 2015

(54) DEVELOPER CONTAINER, DEVELOPING DEVICE INCLUDING DEVELOPER CONTAINER, AND IMAGE FORMING APPARATUS INCLUDING DEVELOPING DEVICE

(71) Applicant: KYOCERA DOCUMENT SOLUTIONS INC., Osaka (JP)

(72) Inventors: Tatsuhiko Yoshii, Osaka (JP); Koji Murata, Osaka (JP); Ryoji Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 173 days.

(21) Appl. No.: 13/857,828

(22) Filed: Apr. 5, 2013

(65) Prior Publication Data

US 2013/0266346 A1 Oct. 10, 2013

(30) Foreign Application Priority Data

Apr. 6, 2012 (JP) ..... 2012-086943

(51) Int. Cl.
*G03G 15/08* (2006.01)

(52) U.S. Cl.
CPC ..... *G03G 15/0832* (2013.01); *G03G 15/0865* (2013.01); *G03G 15/0879* (2013.01); *G03G 15/0863* (2013.01); *G03G 2215/0132* (2013.01)

(58) Field of Classification Search
CPC ..... G03G 15/0832; G03G 15/0863; G03G 21/1647
USPC ..... 399/12, 262
See application file for complete search history.

(56) References Cited

U.S. PATENT DOCUMENTS

| | | | | |
|---|---|---|---|---|
| 8,565,651 | B2 | 10/2013 | Fujii | |
| 2010/0232813 | A1* | 9/2010 | Okamoto | 399/12 |
| 2011/0236076 | A1 | 9/2011 | Fujii | |

FOREIGN PATENT DOCUMENTS

| | | | |
|---|---|---|---|
| JP | 2005-316282 | A | 11/2005 |
| JP | 2006-349783 | A | 12/2006 |
| JP | 2010-032594 | A | 2/2010 |
| JP | 2011-191618 | A | 9/2011 |
| JP | 2011-203441 | A | 10/2011 |

OTHER PUBLICATIONS

An Office Action; "Notice of Reasons for Rejection," issued by the Japanese Patent Office on Jun. 24, 2014, which corresponds to Japanese Patent Application No. 2012-086943 and is related to U.S. Appl. No. 13/857,828.

* cited by examiner

*Primary Examiner* — Erika J Villaluna
(74) *Attorney, Agent, or Firm* — Studebaker & Brackett PC

(57) ABSTRACT

A developer container is fitted in a first direction to an image forming apparatus for forming an image on a sheet. The developer container includes a main body and a protrusion. An inner space filled with a developer is formed in the man body. The protrusion protrudes outward from an outer wall of the main body. The protrusion includes a plurality of wall surface parts facing in a direction opposite to the first direction. An order in which the plurality of wall surface parts are arranged when viewed in the first direction is different from an order in which the plurality of wall surface parts are arranged when viewed in a second direction intersecting with the first direction. A plurality of wall parts are formed integrally to connect the plurality of wall surface parts through the plurality of wall parts.

15 Claims, 17 Drawing Sheets

DEVELOPER CONTAINER, DEVELOPING DEVICE INCLUDING DEVELOPER CONTAINER, AND IMAGE FORMING APPARATUS INCLUDING DEVELOPING DEVICE

INCORPORATION BY REFERENCE

The present application claims priority under 35 U.S.C. §119 to Japanese Patent Application No. 2012-086943, filed Apr. 6, 2012. The contents of this application are incorporated herein by reference in their entirety.

BACKGROUND

The present disclosure relates to a developer container suitable for application to image forming apparatuses, such as copiers, printers, etc., a developing device including such a developer container, and an image forming apparatus including such a developing device.

Conventionally, in image forming apparatuses of electrographic type, a developing device visualizes as a toner image an electrostatic latent image formed on the surface of a photosensitive drum as an image carrier. The toner image is transferred to a recording medium (paper, a viewgraph, or the like), thereby performing image formation. In an image forming apparatus, when the amount of remaining toner in the developing device becomes less than a predetermined amount, toner is supplied from a toner container connected to the developing device.

When the toner container is emptied of the toner in image formation, the user replaces the toner container. In order to do so, the toner container is mounted detachably to the body of the image forming apparatus. The user removes the emptied old toner container from the body of the device. Then, the user fits a new toner container filled with toner to the device body.

Specifications for the toner container detachably mounted to the body of the image forming apparatus may be set differently depending on the type of the image forming apparatus, an operating environment, etc. The specifications may be set according to the country or area where the image forming apparatus is used, the printing speed of the device, the color and materials of the toner, etc. For this reason, if a new toner container set according to an inappropriate specification would be fitted in error in replacement of the toner container, malfunction of the device and/or degradation of print quality may be caused.

In view of the above, various techniques for prevention of erroneous fitting of the toner container are provided. For example, a plurality of protrusions are formed on the bottom surface of a toner container in some image forming apparatus. The arrangement of the plurality of protrusions differs according to the specification of the toner container. On the other hand, a sliding member is provided at a fitting part of the device body where the toner container is to be fitted. The sliding member includes a plurality of contact parts capable of being in contact with the plurality of projections. The plurality of contact parts of the sliding member are arranged correspondingly to the arrangement of the plurality of protrusions of the toner container. Accordingly, if the arrangement of the protrusions is different from that of the contact parts, the sliding member cannot be moved. Thus, the toner container is prevented from being fitted to the device body. Each arrangement of the protrusions and the contact parts is made differ according to the specification of the toner container to prevent erroneous fitting of the toner container.

SUMMARY

A developer container according to one aspect of the present disclosure 1 is fitted in a first direction to an image forming apparatus for forming an image on a sheet. The developer container includes a main body and a protrusion. An inner space filled with a developer is formed in the main body. The protrusion protrudes outward from an outer wall of the main body. The protrusion includes a plurality of wall surface parts facing in the first direction. An order in which the plurality of wall surface parts are arranged when viewed in the first direction is different from an order in which the plurality of wall surface parts are arranged when viewed in a second direction intersecting with the first direction. A plurality of wall parts are formed integrally to connect the plurality of wall surface parts through the plurality of wall parts.

A developing device according to another aspect of the present disclosure includes a developer container, a fitting part, and a developer housing. The developer container is configured to be filled with a developer. The developer container is fitted in a first direction to the fitting part. The developer is supplemented to the developer housing. The developer container includes a main body and a protrusion. An inner space filled with a developer is formed in the main body. The protrusion protrudes outward from an outer wall of the man body. The protrusion includes a plurality of wall surface parts facing in the first direction. An order in which the plurality of wall surface parts are arranged when viewed in the first direction is different from an order in which the plurality of wall surface parts are arranged when viewed in a second direction intersecting with the first direction. A plurality of wall parts are formed integrally to connect the plurality of wall surface parts through the plurality of wall parts. The fitting part includes an opposing member to which the protrusion of the developer container is fitted when the developer container is fitted in the first direction. The opposing member includes a plurality of opposing wall surface parts configured to face the plurality of wall surface parts of the protrusion in the first direction. The plurality of opposing wall surface parts of the opposing member has an arrangement pattern, which is the same as an arrangement pattern of the plurality of wall surface parts of the protrusion.

An image forming apparatus according to still another aspect the present disclosure includes the developing device according to the above other aspect, an image carrier, and a transfer section. The image carrier is configured to carry a developer image visualized by a developer supplied from the developing device as a latent image formed on a peripheral surface thereof. The transfer section configured to transfer the developer image from the image carrier to a sheet.

DETAILED DESCRIPTION

Figure 1:
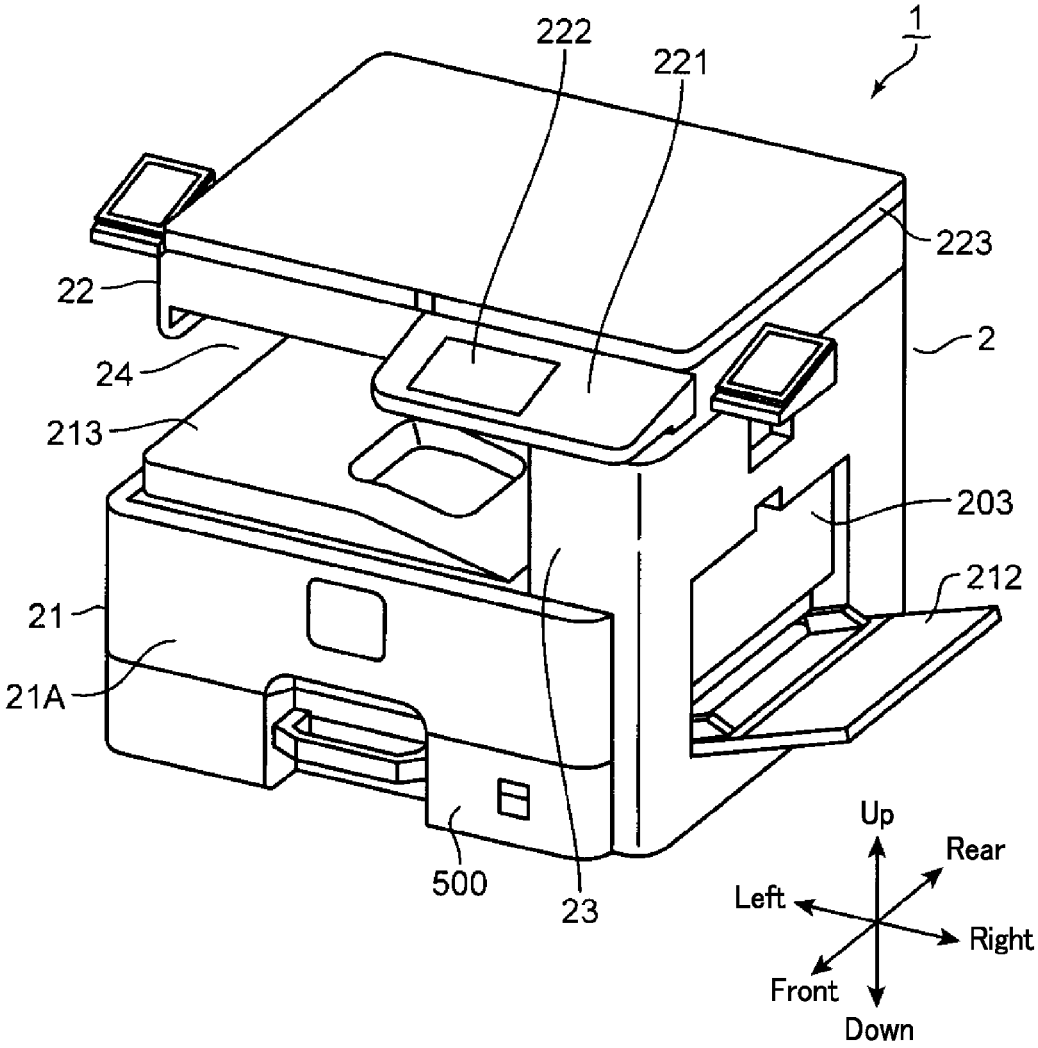
FIG. 1 is a perspective view of an image forming apparatus according to one embodiment of the present disclosure.

Embodiments of the present disclosure will be described below with reference to the accompanying drawings. In the drawings, like numerals denote like or corresponding elements to omit the description thereof. It is noted that the term, "sheet(s)" in the following description means any of copier paper, coated paper, viewgraph, cardboard, post card, tracing paper, another sheet material to be subjected to image formation, and sheet material to be subjected to arbitrary processing other than the image formation.

Figure 2:
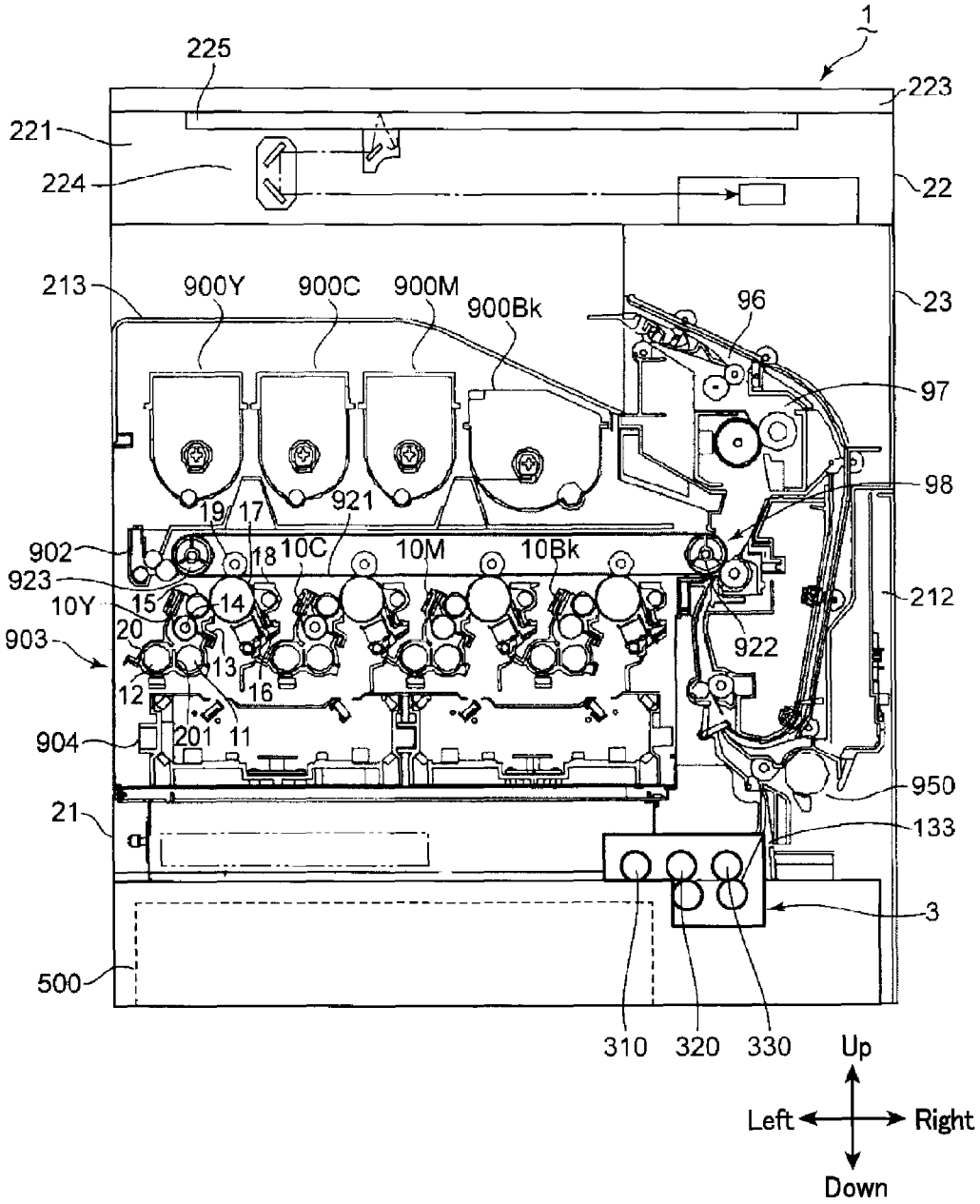
FIG. 2 is a cross sectional view showing an internal configuration of the image forming apparatus.

FIG. 1 is a perspective view of an image forming apparatus according to one embodiment of the present disclosure. FIG. 2 is a diagram schematically showing the internal configuration of the image forming apparatus shown in FIG. 1. The image forming apparatus shown in FIGS. 1 and 2 is a copier of generally called an inner output type. It is noted that in other embodiments, the image forming apparatus may be a printer, a facsimile machine, a multifunction peripheral having the functions of them, or any other device for forming a toner image on a sheet.

Referring to FIG. 1, an image forming apparatus 1 includes a main housing 2 (a main body of the image forming apparatus 1) having a substantially rectangular parallelepiped shape. The main housing 2 includes a lower housing 21, an upper housing 22, and a joint housing 23. The lower housing 21 is substantially a rectangular parallelepiped in shape. The upper housing 22 is provided above the lower housing 21. The joint housing 23 connects the lower housing 21 with the upper housing 22. The joint housing 23 extends along the right edge and the back edge of the main housing 2. The sheet subjected to printing is ejected to an ejection space 24 surrounded by the lower housing 21, the upper housing 22, and the joint housing 23.

The image forming apparatus 1 includes an operation section 221. The operation section 221 is provided at the upper housing 22 so as to protrude frontward of the image forming apparatus 1. The operation section 221 includes, for example, an LCD touch panel 222. The operation section 221 is capable of receiving information relating to image formation. The user may input, for example, the number of sheets to be printed, a print density, and the like through the LCD touch panel 222. The upper housing 22 generally accommodates equipment for reading image of an original document and an electronic circuit that governs control of the entire image forming apparatus 1.

The image forming apparatus 1 includes an original cover 223 arranged on the upper housing 22. The original cover 223 is used for confining the original document. The original cover 223 is mounted at the upper housing 22 vertically rotatably about the rear edge of the upper housing 22 as an axis. The user turns the original cover 223 upward of the upper housing 22 and places the original document on the upper housing 22. Then, the user can operate the operation section 221 to allow the equipment accommodated in the upper housing 22 to read the image of the original document.

A sheet tray 500, which accommodates a plurality of sheets, is provided in the lower housing 21. The sheet tray 500 is capable of being drawn from the lower housing 21 frontward of the image forming apparatus 1. A sheet P accommodated in the sheet tray 500 is sent out upward of the image forming apparatus 1 within the lower housing 21. On the basis of an instruction input through the operation section 221 by the user, image formation is performed on the sheet P within the housing 21. Then, the sheet P is ejected into the ejection space 24.

On the right surface of the lower housing 21, a tray 212 is mounted so as to be openable/closable. As shown in FIG. 1, when the tray 212 is positioned so as to protrude rightward from the lower housing 21, the user can place the sheet on the tray 212. After the sheet on the tray 212 is drawn into the lower housing 21, image formation is performed on the sheet P on the basis of the instruction input through the operation section 221 by the user. Then, the sheet P is ejected into the ejection space 24. When the tray 212 is turned upward about the lower edge of the tray 212 as an axis, the tray 212 is accommodated in an accommodation space 203, which is recessed in the right surface of the lower housing 21. Accordingly, a sheet supply port to draw the sheet inside the lower housing 21 is blocked.

The lower housing 21 accommodates various types of equipment for image formation on the sheet. Some of the equipment is exposed at the front of the image forming apparatus 1 by opening a front cover 21A of the lower housing 21. Further, the joint housing 23 accommodates various types of equipment to eject the sheet subjected to image formation into the ejection space 24.

Referring to FIG. 2, the upper housing 22 accommodates a scanning mechanism 224. The user can allow the image forming apparatus 1 to read the image of a desired original document through the scanning mechanism 224. A contact glass 225, which is mounted on the upper surface of the upper housing 22, is provided over the scanning mechanism 224. The original cover 223 is used for confining the original document placed on the contact glass 225. When the user operates the image forming apparatus 1 through the operation section 221, the scanning mechanism 224 scans and reads the image of the original document on the contact glass 225. Analog information of the image read by the scanning mechanism 224 is converted to a digital signal. The image forming apparatus 1 forms an image onto the sheet on the basis of the digital signal.

The lower housing 21 accommodates toner containers 900 (a yellow toner container 900Y, a magenta toner container 900M, a cyan toner container 900C, and a black toner container 900Bk), an intermediate transfer unit 902 (a transfer section), an image forming section 903, an exposure unit 904, a fusing unit 97, and a conveyance unit 3. The joint housing 23 accommodates a paper exit unit 96.

The image forming section 903 includes the toner containers 900 (the yellow toner container 900Y, the magenta toner container 900M, the cyan toner container 900C, and the black toner container 900Bk). A developing counter 10Y, a developing counter 10M, a developing counter 10C, a developing counter 10Bk are provided below the respective toner containers 900 of the respective colors of Y, M, C, and Bk.

The image forming section 903 includes four photosensitive drums 17 (image carriers) that correspond to the respective four colors of Y, M, C, and Bk. It is noted that in FIG. 2, reference numerals for the photosensitive drums 17 for M, C, and Bk colors other than for the yellow color Y is omitted for the sake of simplicity. Each photosensitive drum 17 carries a toner image (a developer image) in the corresponding color. Photosensitive drums made of amorphous silicon (a-Si) based material are used as the photosensitive drums 17.

A charger 16, the developing counter 10 (10Y, 10M, 10C, or 10Bk), a transfer unit 19, and a cleaning unit 18 are arranged around each photosensitive drum 17. It is noted that in FIG. 2, reference numerals for the chargers, the transfer units, and the cleaning units arranged around the respective photosensitive drums for M, C, and Bk colors other than those for yellow color Y are omitted for the sake of simplicity. The charger 16 electrically charges the surface of the corresponding photosensitive drum 17 uniformly. After electrostatic charging, the exposure unit 904 exposes the surface of each photosensitive drum 17, thereby forming an electrostatic latent image. The exposure unit 904 irradiates laser light on the basis of the digital signal generated by the scanning mechanism 224.

Each of the developing counter 10Y, the developing counter 10M, the developing counter 10C, and the developing counter 10Bk develops (form visible images of or visualize) the electrostatic latent image formed on the peripheral surface of each photosensitive drum 17 with the use of corresponding color toner (developers) supplied from the yellow toner container 900Y, the magenta toner container 900M, the cyan toner container 900C, or the black toner container 900Bk, thereby forming a toner image (a developer image) on the photosensitive drum 17. The transfer rollers 19 and the photosensitive drums 17 form nips to nip an intermediate transfer belt 921. The transfer rollers 19 primarily transfer the toner images carried on the photosensitive drums 17 to the intermediate transfer belt 921. The cleaning units 18 clean the peripheral surfaces of the photosensitive drums 17 after transfer of the toner images.

Each of the developing counter 10Y, the developing counter 10M, the developing counter 10C, and the developing counter 10Bk includes a developer housing 20. Two-component developer is filled in the developer housing 20. The two-component developer includes a magnetic carrier and toner. Further, two stirring rollers (a stirring roller 11 and a stirring roller 12) are arranged in parallel in the vicinity of the bottom of the developer housing 20. For example, the two stirring rollers (the stirring roller 11 and the stirring roller 12) are arranged rotatably about their axes in the longitudinal direction of the rollers 11, 12 as the axial direction.

A circulation path for the developer is formed in the inner bottom surface of the developer housing 20. The stirring roller 11 and the stirring roller 12 are provided inside the circulation path. A partition wall 201 is provided in the axial direction between the stirring roller 11 and the stirring roller 12. The partition wall 201 stands from the bottom of the developer housing 20 to define the circulation path. The circulation path is formed around the partition wall 201. The two-component developer is conveyed through the circulation path, while being stirred by the stirring roller 11 and the stirring roller 12 in the circulation path. For example, the two-component developer is electrostatically charged while being stirred and conveyed.

The two-component developer circulates in the developer housing 20, while being stirred by the stirring roller 11 and the stirring roller 12, thereby electrostatically charging the toner of the two-component developer. The two-component developer on the stirring roller 11 is sucked to a magnetic roller 14 located above the stirring roller 11 to be conveyed. The sucked two-component developer forms a magnetic brush (not shown) on the magnetic roller 14. A doctor blade 13 restricts the layer thickness of the magnetic brush. The magnetic brush supplies the toner to the developing roller 15 located above the magnetic roller 14. The toner layer on the developing roller 15 is formed by the potential difference between the magnetic roller 14 and the developing roller 15. The toner layer develops the electrostatic latent image on the photosensitive drum 17.

It is noted that in FIG. 2, reference numerals for the respective developer housings, the respective two stirring rollers, the respective partition walls, the respective magnetic rollers, the respective doctor blades of the developing counter 10M, the developing counter 10C, and the developing counter 10Bk other than those of the yellow developing counter 10Y are omitted for the sake of simplicity.

The exposure unit 904 includes a light source and various types of optical systems, such as a polygon mirror, a reflecting mirror, a deflection mirror, etc. The exposure unit 904 irradiates light based on image data to the peripheral surfaces of the photosensitive drums 17 provided in the image forming section 903 to form electrostatic latent images.

The intermediate transfer unit 902 includes the intermediate transfer belt 921, a drive roller 922, and a driven roller 923. The toner images from the plurality of photosensitive drums 17 are applied and overlaid on the intermediate transfer belt 921 (primary transfer). In the secondary transfer section 98, the overlaid toner images are secondarily transferred to the sheet supplied from the sheet tray 500 or the tray 212 (see FIG. 1). The drive roller 922 and the driven roller 923 drive and rotate the intermediate transfer belt 921. The drive roller 922 and the driven roller 923 are rotatably supported to the lower housing 21.

It is noted that, for example, the intermediate transfer unit 902 (the transfer section) forms part of the secondary transfer section 98. Accordingly, the intermediate transfer unit 902 has a function of transferring the toner images (developer images) from the photosensitive drums 17 (image carriers) to the sheet.

The fusing unit 97 fuses the toner images secondarily transferred on the sheet from the intermediate transfer unit 902. The sheet with a color image subjected to fusing is ejected toward the paper exit unit 96 formed above the fusing unit 97 (in the joint housing 23).

The paper exit unit 96 ejects the sheet conveyed from the fusing unit 97 onto the upper surface 213 of the lower housing 21 serving as an exit tray.

The conveyance unit 3 is provided at the lower housing 21 so as to face the sheet tray 500. The conveyance unit 3 includes a pickup roll 310, a paper supply roll 320, and a conveyance roller 330. When the pickup roll 310 and the paper supply roll 320 provided in the conveyance unit 3 are driven and rotated, the uppermost sheet of a sheaf of sheets in the sheet tray 500 is taken out sheet by sheet. Further, the taken-out sheet is send out by the conveyance roller 330 downstream of a sheet conveyance path 133 and is introduced into the image forming section 903. The pickup roll 310, the paper supply roll 320, and the conveyance roller 330 form part of the sheet conveyance path 133. The sheet is conveyed to the image forming section 903 through the sheet conveyance path 133.

Figure 3:
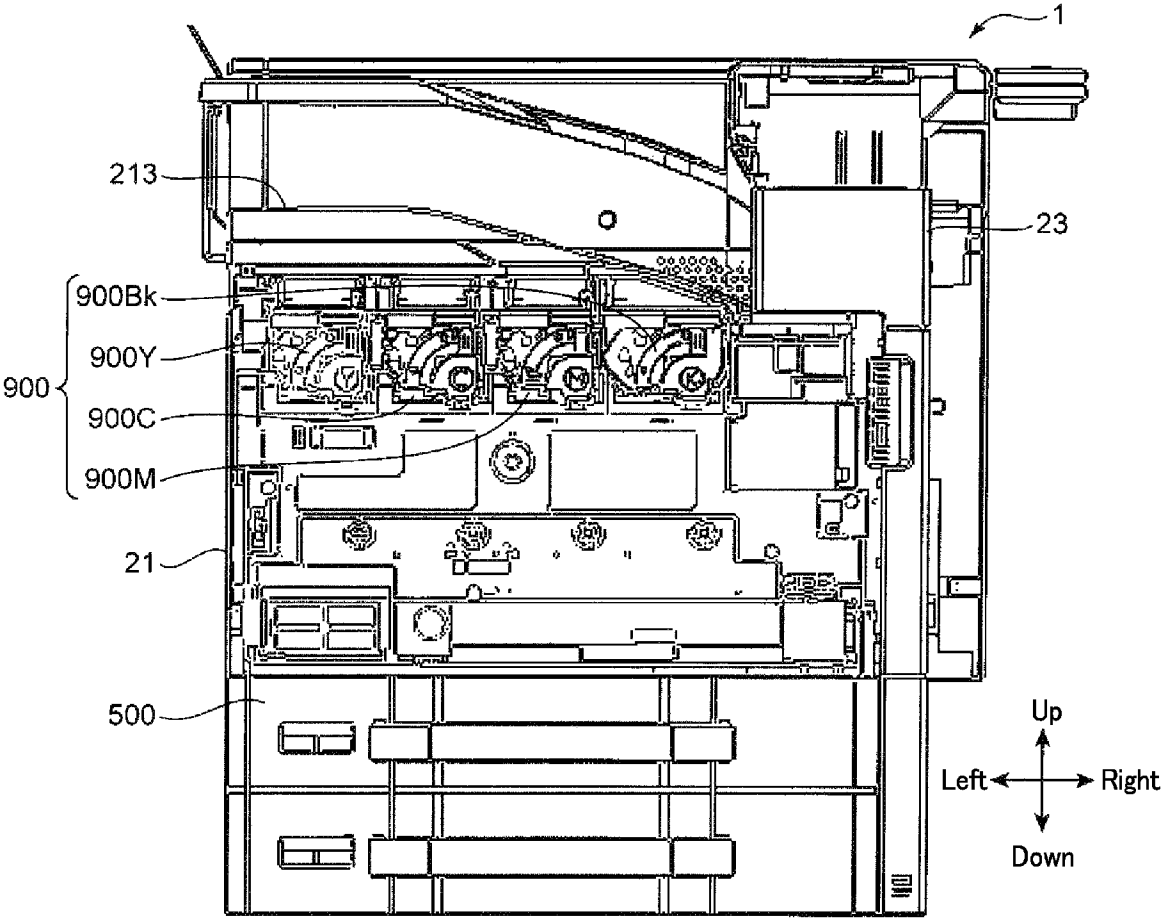
FIG. 3 is a front view showing the locations of toner containers fitted to the image forming apparatus according to one embodiment of the present disclosure.
Figure 4:
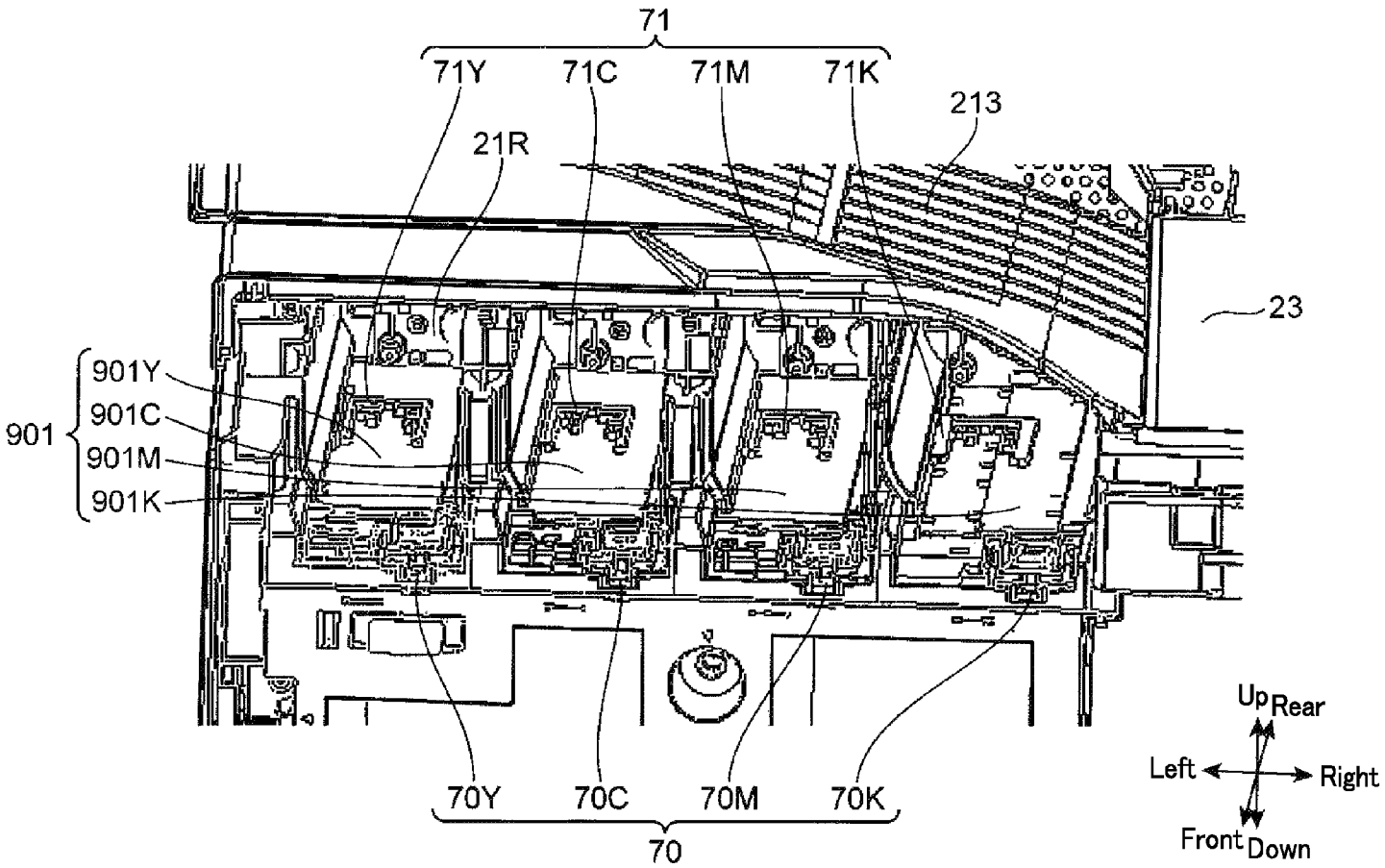
FIG. 4 is a cross-sectional perspective view showing part of the image forming apparatus where the toner containers are fitted according to one embodiment of the present disclosure.

Described in detail next will be the arrangement and configuration of the toner containers 900 in the image forming apparatus 1 according to the present embodiment. FIG. 3 is a front view showing the state when the front cover 21A (FIG. 1) of the image forming apparatus 1 is opened. FIG. 4 is a cross-sectional perspective view showing, in an enlarged scale, part around container insertion surfaces 901 when the toner containers 900 are taken out. FIG. 4 corresponds to a cross sectional view taken at substantially the central part of the image forming apparatus 1 in the front-back direction (direction orthogonal to the paper of FIGS. 2 and 3).

Referring to FIG. 3, the toner containers 900 (the yellow toner container 900Y, the magenta toner container 900M, the cyan toner container 900C, and the black toner container 900Bk) are arranged in parallel at regular intervals below the upper surface 213 of the lower housing 21. Referring to FIG. 4, a space where the toner containers 900 are fitted is formed in the lower housing 21. Container insertion surfaces 901 (a yellow container insertion surface 901Y, a magenta container insertion surface 901M, a cyan container insertion surface 901C, and a black container insertion surface 901Bk) (a fitting part) defines the bottom of the space. The toner containers 900 are pushed toward the rear side (a first direction) along the container insertion surfaces 901 to be inserted into the lower housing 21.

Toner ejection sections 70 are disposed below the container insertion surfaces 901. Supplemental toner is dropped from an opening 841 of each toner container 900, which will be described later, onto the corresponding toner ejection section 70. The supplemental toner is supplied to the developing counters 10 (the developing counter 10Y, the developing counter 10M, the developing counter 10C, and the developing counter 10Bk) from the toner ejection sections 70 through toner conveyance paths (not shown).

Further, main body protrusions 71 (a yellow main body protrusion 71Y, a magenta main body protrusion 71M, a cyan main body protrusion 71C, and a black main body protrusion 71Bk) (opposing member) are arranged at the back (on the rear side) of the container insertion surfaces 901. The main body protrusions 71 come in contact with container protrusions 85 (FIG. 5), which are formed on the toner containers 900, in the front-back direction. The main body protrusions 71 can prevent erroneous fitting of the toner containers 900.

Developing devices of the respective colors in the present embodiment include the developing counters 10, the container insertion surfaces 901, the main body protrusions 71, the toner containers 900 fitted on the container insertion surfaces 901, the toner conveyance paths (not shown), etc.

Figure 5:
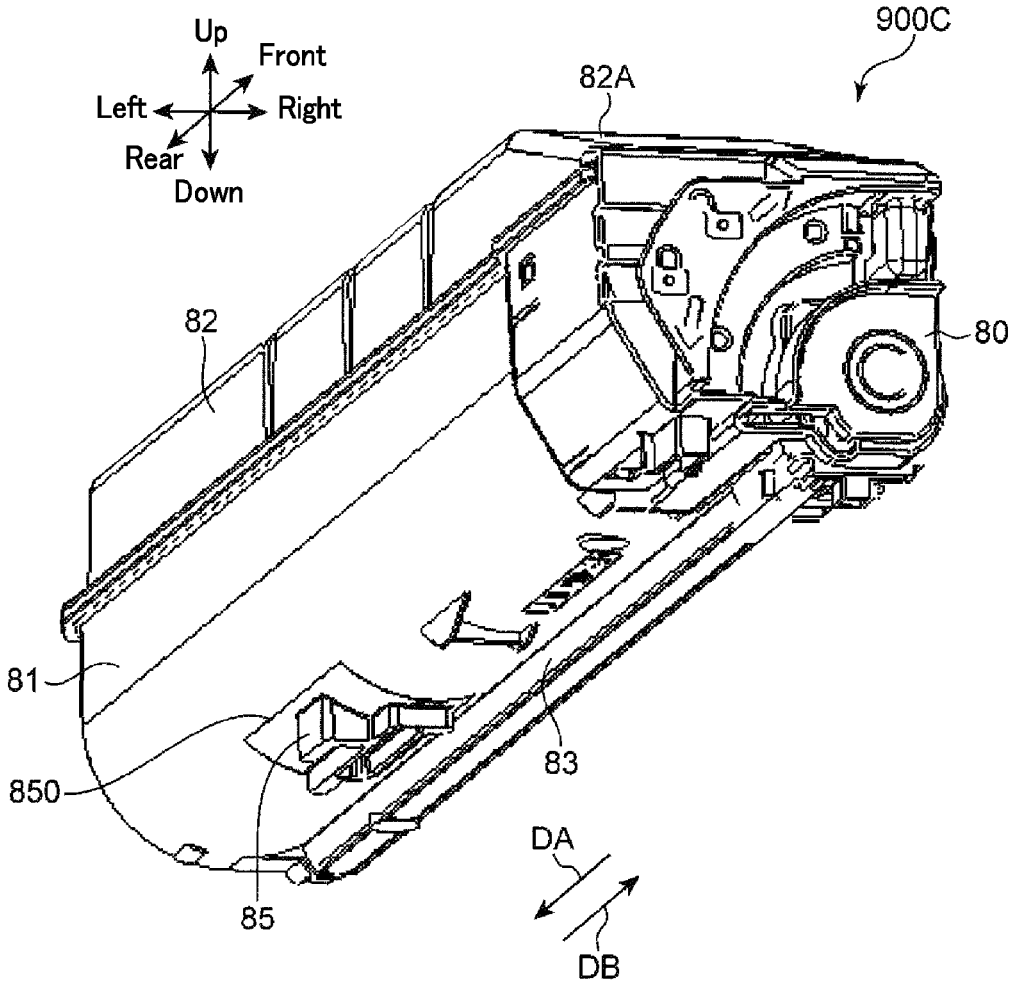
FIG. 5 is a perspective view of a toner container according to one embodiment of the present disclosure.
Figure 6:
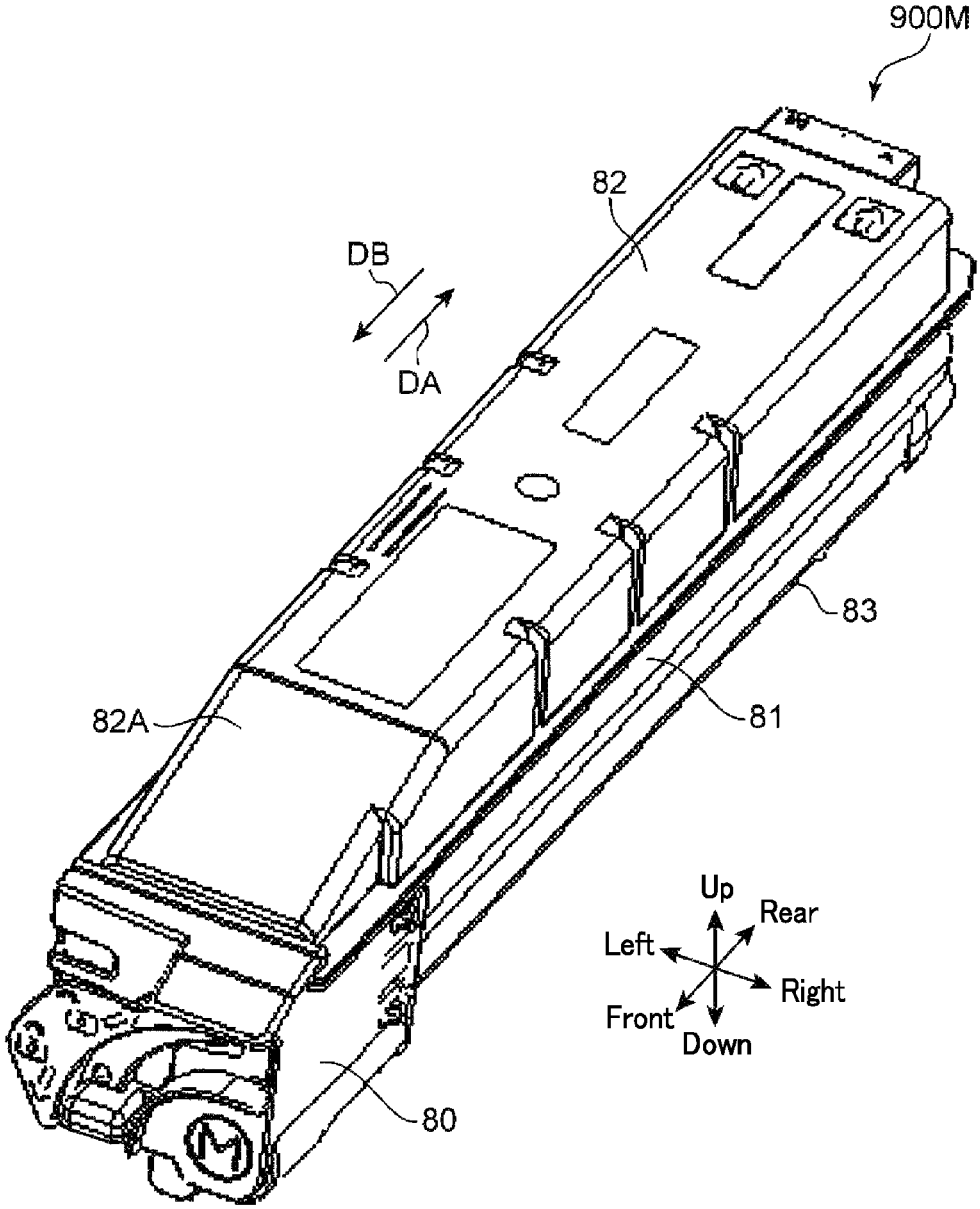
FIG. 6 is a perspective view of a toner container according to one embodiment of the present disclosure.
Figure 7:
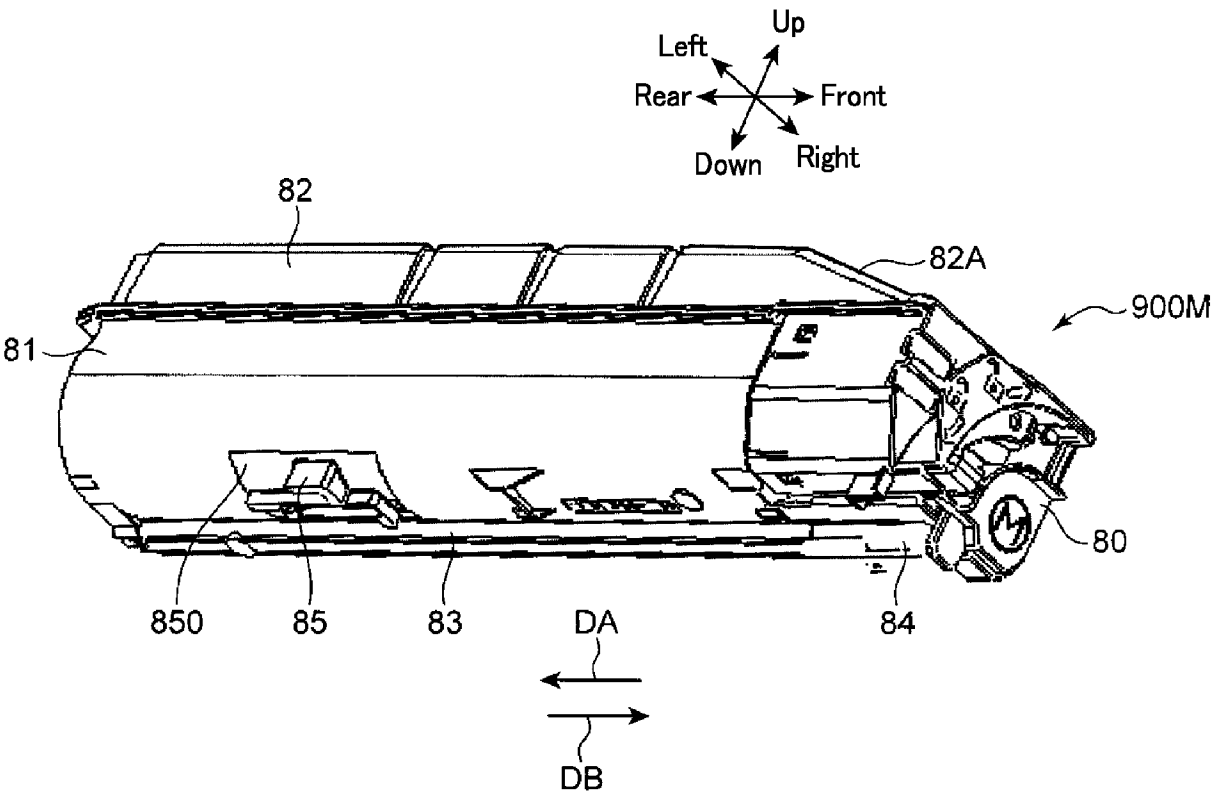
FIG. 7 is a perspective view of a toner container according to one embodiment of the present disclosure.
Figure 8:
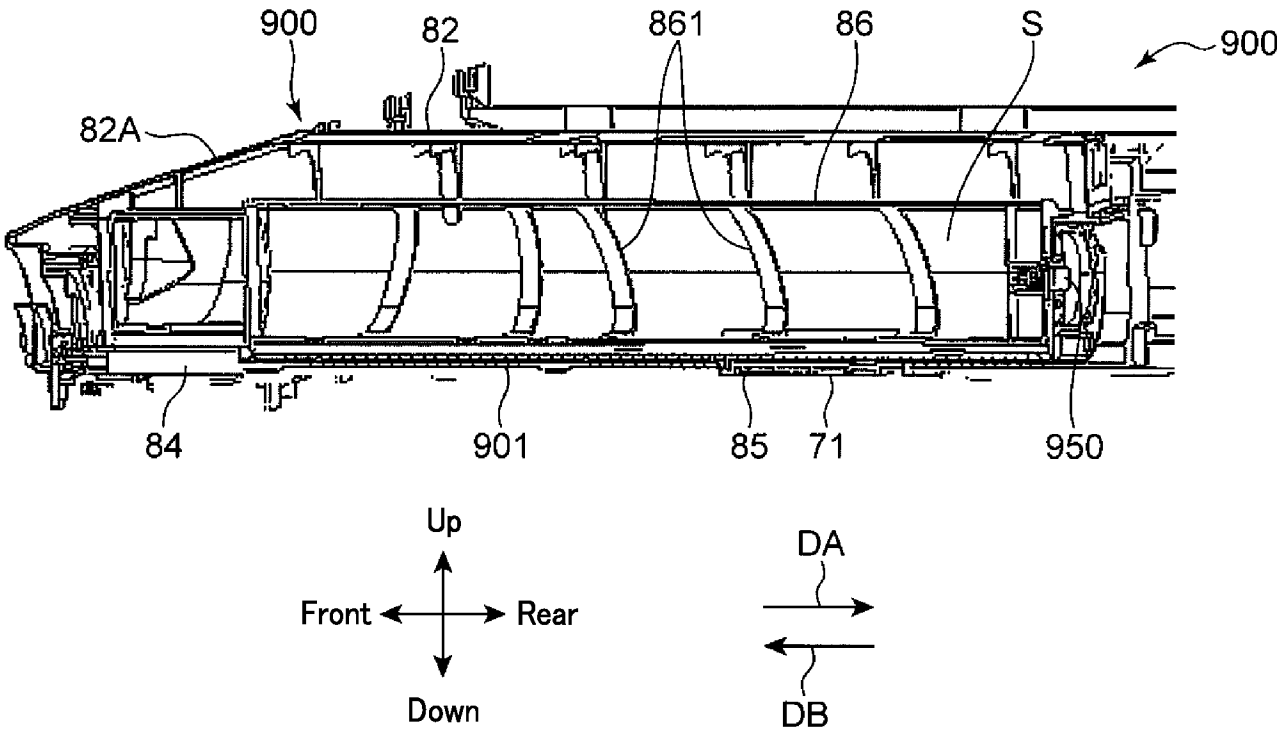
FIG. 8 is a cross sectional view of a toner container according to one embodiment of the present disclosure.
Figure 9:
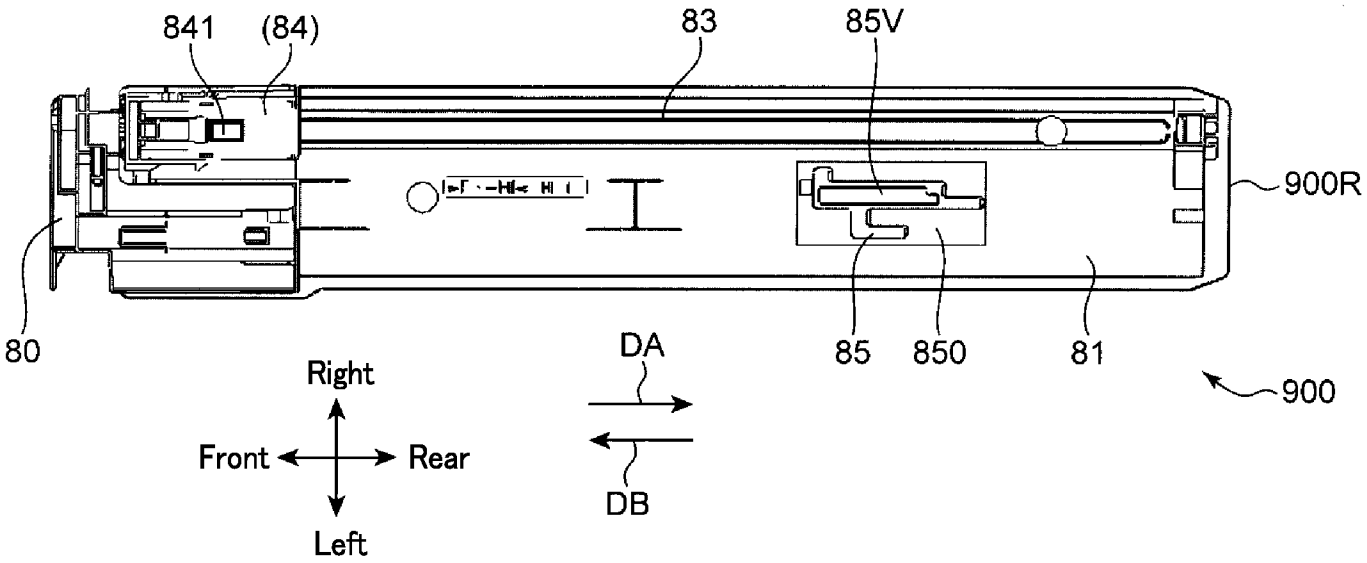
FIG. 9 is a bottom view of a toner container according to one embodiment of the present disclosure.

FIGS. 5-7 are perspective views of one of the toner containers 900. FIG. 8 is a cross sectional view of one of the toner containers 900 taken in the longitudinal direction of the toner container 900 and shows the state when the toner container 900 is fitted on one of the container insertion surfaces 901 of the lower housing 21. Further, FIG. 9 is a bottom view of the toner container 900. It is noted that, further in detail, FIG. 5 is a perspective view of the cyan toner container 900C, and FIGS. 6 and 7 are perspective views of the magenta toner container 900M. Since the cyan toner container 900C and the magenta toner container 900M are the same in shape and configuration, they are hereinafter referred to as a toner container 900. Furthermore, in FIGS. 5-9, the arrows DA indicate the direction where the toner container 900 is fitted to the image forming apparatus 1, and the arrows DB indicate the direction where the toner container 900 is taken out from the image forming apparatus 1.

The toner container 900 has a box shape extending in the front-back direction (the first direction) when it is fitted in the lower housing 21. The toner container 900 includes a front part 80, a main body part 81, a top plate 82, and a conveyance part 83. In addition, the toner container 900 includes a shatter 84 and the container protrusion 85.

The front part 80 serves as a covering member that defines the front of the toner container 900. The toner container 900 is substantially cylindrical in shape. The character Y, M, C, or K is engraved at the lower right part of the front surface of the front part 80 according to the color of the toner filled in the toner container.

The main body part 81 (a main body) extends on the rear side of the front part 80 in the longitudinal direction of the toner container 900. The main body part 81 serves as a main body part of the toner container 900. The main body part 81 forms an inner space S (see FIGS. 8, 18, and 19), in which the toner (developer) is filled. The main body part 81 has a substantially U-shape when viewed in cross section extending in the vertical and transverse directions.

The top plate 82 defines the upper part of the toner container 900. The top plate 82 covers each upper part of the front part 80 and the main body part 81 in the longitudinal direction of the toner container 900. The top plate 82 includes on the front side thereof a top plate front part 82A. The top plate front part 82A is formed so that the front part of the top plate 82 is inclined downward as it goes toward the front. The top plate front part 82A covers the upper part of the front part 80.

The conveyance section 83 is formed on the right side of the lower end of the main body part 81 in a fashion that the main body part 81 is raised downward in the longitudinal direction of the toner container 900. The conveyance section 83 is substantially in a U-shape when viewed in cross section extending in the vertical and transverse directions. The conveyance section 83 partially increases the inner space S of the main body part 81. A conveyance member 831 (FIG. 18) is disposed in the increased space. The conveyance member 831 conveys the toner filled in the inner space S in the longitudinal direction of the toner container 900. In the present embodiment, the conveyance member 831 conveys the toner from the rear side to the front side of the toner container 900.

The shatter 84 is arranged in front of the conveyance section 8 in the lower part of the main body part 813. The shatter 84 is capable of sliding in the longitudinal direction of the toner container 900. The shatter 84 covers the opening 841 (FIG. 9) formed in the lower surface of the main body part 81. When the toner container 900 is fitted in the lower housing 21, the shatter 84 is moved and slid frontward. This exposes the opening 841 downward. The toner, which is conveyed frontward in the toner container 900 by the conveyance member 831, is dropped into the toner ejection section 70 through the opening 841.

The container protrusion 85 (protrusion) is formed on the lower surface of the main body part 81 on the rear side of the central part of the main body part 81 in the longitudinal direction (the front-back direction) of the toner container 900. In other words, the container protrusion 85 is formed on part of the main body part 81, which is closer to one (a rear surface 81A in FIG. 20) of the end parts of the main body 81 than the other end part (front surface 81B in FIG. 20). The one end part (the rear surface 81A) of the main body part 81 is inserted earlier than the other end part (the front surface 81B) of the main body part 81 in fitting the toner container 900 into the image forming apparatus 1.

In the present embodiment, the container protrusion 85 protrudes downward at part of the main body part 81. Combination of the container protrusion 85 and the main body protrusion 71 can prevent the toner container 900 from being fitted erroneously into the lower housing 21. The shape and configuration of the container protrusion 85 will be described later with reference to FIGS. 10-20.

The toner container 900 further includes a stirring section 86 (FIG. 8). The stirring section 86 is driven and rotated in the inner space S of the toner container 900. The stirring section 86 includes raking portions 861. The raking portions 861 are wings disposed at plural points in the longitudinal direction of the stirring section 86. Further, the raking portions 861 are arranged with inclination at a predetermined angle with respect to the longitudinal direction of the toner container 900. By rotation of the raking portions 861, the toner filled in the inner space S is moved in the longitudinal direction of the toner container 900 toward the conveyance member 831 when viewed in cross section of the toner container 900. A drive/transmission section 950 is disposed at the rear part of the toner container 900. The drive/transmission section 950 is connected to a drive section (not shown) disposed in the lower housing 21 of the image forming apparatus 1 to transmit rotational drive power to the stirring section 86.

Figure 10:
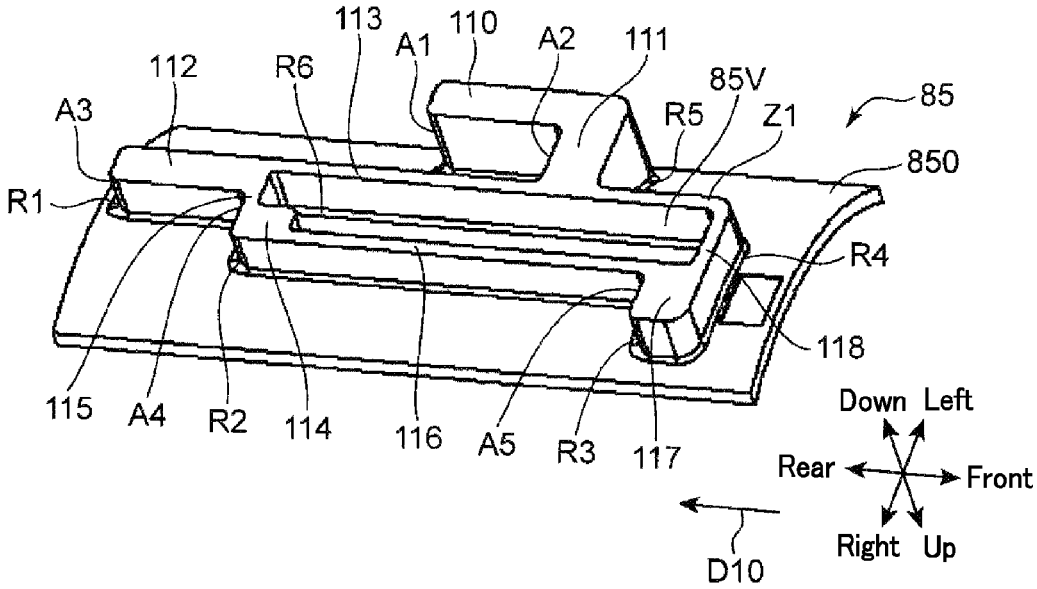
FIG. 10 is a perspective view of a container protrusion according to one embodiment of the present disclosure.
Figure 11:
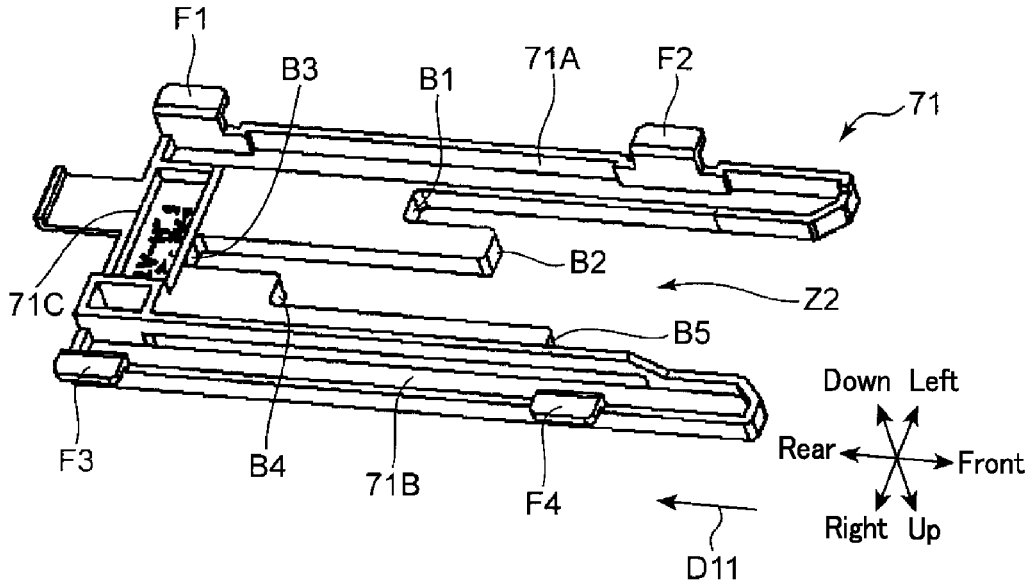
FIG. 11 is a perspective view of a main body protrusion according to one embodiment of the present disclosure.

Detailed description will be made next about the configurations of the container protrusion 85 and the main body protrusion 71. FIG. 10 is a perspective view of the container protrusion 85. FIG. 11 is a perspective view of the main body protrusion 71. FIG. 10 is an enlarged view of the container protrusion 85 formed on the lower surface of the main body part 81 of the toner container 900. That is, FIG. 10 shows the state where the toner container 900 is turned over upside down.

The container protrusion 85 is formed on a protrusion forming surface 850 (FIGS. 5 and 7) in the lower surface of the main body part 81. It is noted that the container protrusion 85 may be fixed to the toner container 900 as a separate member. However, in the present embodiment, the container protrusion 85 is integrally formed with the main body part 81 in molding the main body part 81.

The container protrusion 85 protrudes downward from the outer wall of the main body part 81. In other words, the container protrusion 85 is a protrusion member protruding from the main body part 81 of the toner container 900 outward of the outer wall of the main body part 81. The container protrusion 85 includes five contact parts (an eleventh contact part A1, a twelfth contact part A2, a thirteenth contact part A3, a fourteenth contact part A4, and a fifteenth contact part A5), each of which is a wall surface part. Each of the five contact parts is a wall surface part of the container protrusion 85, which faces in a direction opposite to an insertion direction (the direction of the arrow DA in FIG. 5 and the direction of the arrow D10 in FIG. 10) (the first direction) of the toner container 90 into the lower housing 21. The eleventh contact part A1, the twelfth contact part A2, the thirteenth contact part A3, the fourteenth contact part A4, the fifteenth contact part A5 are arranged in this order from left to right in the transverse direction (a second direction) of the container protrusion 85.

Further, in the present embodiment, the five contact parts are arranged so that the thirteenth contact part A3 is formed at the rearmost part, and the fourteenth contact part A4, the eleventh contact part A1, the twelfth contact part A2, and the fifteenth contact part A 5 are formed in this order in the front-back direction (the first direction) of the container protrusion 85. That is, the five contact parts form an arrangement pattern in which the positions of the five contact parts are different between when viewed in the front-back direction (the first direction) and when viewed in the transverse direction (the second direction). In other words, the order in which the contact parts A1-A5 are arranged in the transverse direction (the second direction) is different from the order in which the contact parts A1-A5 are arranged in the front-back direction (the first direction) intersecting with the transverse direction. That is, the order in which the contact parts A1-A5 are arranged when viewing the container protrusion 85 in the front-back direction (the first direction) is different from the order in which the contact parts A1-A5 are arranged when viewing the container protrusion 85 in the transverse direction (the second direction) intersecting with the front-back direction.

Further, the container protrusion 85 is in an integrally protruding shape that connects the five contact parts together. The container protrusion 85 is composed of a plurality of wall parts. Some of the plurality of wall parts stand in the insertion direction of the toner container 900 to form a first wall group. The other wall parts of the plurality of wall parts stand in the transverse direction (a direction orthogonal to the insertion direction of the toner container 900) to form a second wall group. Referring to FIG. 10, the container protrusion 85 includes a first wall part 110, a second wall part 111, a third wall part 112, a fourth wall part 113, a fifth wall part 114, a sixth wall part 115, a seventh wall part 116, an eighth wall part 117, and a ninth wall part 118.

The first wall part 110 is formed at a left end part of the container protrusion 85 in the insertion direction of the toner container 900 so as to have a predetermined width in the transverse direction. The eleventh contact part A1 corresponds to the rear wall surface of the first wall part 110. The second wall part 111 is connected to the front end of the first wall part 110. The second wall part 111 is formed from the front end of the first wall part 110 toward the right. The twelfth contact part A2 corresponds to the rear wall surface of the second wall part 111. The third wall part 112 is formed on the right side of the first wall part 110 and on the rear side of the rear end of the first wall part 110 in the insertion direction of the toner container 900 so as to have a predetermined width in the transverse direction. The thirteenth contact part A3 corresponds to the rear wall surface of the third wall part 112.

The fourth wall part 113 is formed from the front end of the third wall part 112 to the front side of the front end of the first wall part 110 in the insertion direction of the toner container 900. The fourth wall part 113 has a width in the transverse direction smaller than the third wall part 112. In other words, the fourth wall part 113 is formed by extending part of the front end of the third wall part 112 frontward. The fourth wall part 113 is connected to the second wall part 111 at substantially the central part thereof in the front-back direction. The fifth wall part 114 is a wall part formed on the right front side of the third wall part 112 so as to slightly extend in the front-back direction. The fourteenth contact part A4 corresponds to the rear wall surface of the fifth wall part 114.

The sixth wall part 115 is a wall part that connects the front end of the third wall part 112 to the rear end of the fifth wall part 114 in the transverse direction. The seventh wall part 116 is formed from the front end of the fifth wall part 114 in parallel to the fourth wall part 113 (the front-back direction). The seventh wall part 116 is formed so as to reach part on the front side of the second wall part 111 in the front-back direction. The eighth wall part 117 is located on the right side of the seventh wall part 116 and is connected to the front end of the seventh wall part 116. The eighth wall part 117 is a wall part substantially in a rectangular parallelepiped shape. The fifteenth contact part A5 corresponds to the rear wall surface of the eighth wall part 117. The ninth wall part 118 is a wall part that connects the front end of the eighth wall part 117 to the front end of the fourth wall part 113 in the transverse direction.

Accordingly, the five contact parts (the eleventh contact part A1, the twelfth contact part A2, the thirteenth contact part A3, the fourteenth contact part A4, and the fifteenth contact part A5) are formed integrally so as to be connected together through the first wall part 110, the second wall part 111, the third wall part 112, the fourth wall part 113, the fifth wall part 114, the sixth wall part 115, the seventh wall part 116, the eighth wall part 117, and the ninth wall part 118. That is, the wall parts 110-118 are formed integrally to connect the five contact parts through the wall parts 110-118. In this case, the first wall part 110, the third wall part 112, the fourth wall part 113, the fifth wall part 114, the seventh wall part 116, and the eighth wall part 117 are the wall parts (the first wall group) formed in the insertion direction of the toner container 900 (the first direction). On the other hand, the second wall part 111, the sixth wall part 115, and the ninth wall part 118 are the wall parts (the second wall group) formed in the direction (the transverse direction, the second direction) orthogonal to (intersecting with) the insertion direction of the toner container 900.

Thus, integral formation of the five contact parts with the wall groups orthogonal to each other can definitely maintain the rigidity of the container protrusion 85. Further, in the present embodiment, the five contact parts are adjacent to one another in the transverse direction. In other words, when viewing the five contact parts in the front-back direction, the five contact parts are arranged adjacent to one another. Accordingly, the container protrusion 85 can be reduced in size in the transverse direction as far as possible. Further, the five contact parts can be prevented from being arranged separately in the transverse direction, thereby maintain rigidity of each contact part at high level. The five contact parts are formed continuously to form a protruding shape Z1 (an outer shape of the container protrusion 85 in cross section extending in the front-back and transverse directions) on the lower end surface of the container protrusion 85.

Referring to FIG. 11, the main body protrusion 71 is substantially in a turned angular U shape. The outer shape of the main body protrusion 71 is defined by a protruding left end part 71A, a protruding right end part 71B, and a protruding base end part 71C. The protruding base end part 71C is a wall part in a thin plate shape formed at the rear part of the main body protrusion 71 so as to extend in the transverse direction. The protruding left end part 71A and the protruding right end part 71B are formed at respective ends in the transverse direction of the protruding base end part 71C so as to extend frontward.

The protruding left end part 71A includes a first protruding piece F1 and a second protruding piece F2. Further, the protruding right end part 71B includes a third protruding piece F3 and a fourth protruding piece F4. The first protruding piece F1 is formed at the rear end part of the protruding left end part 71A. The first protruding piece F1 is a protruding piece protruding leftward from the lower end of the protruding left end part 71A. Further, the second protruding piece F2 is formed between the central part in the front-back direction of the protruding left end part 71A and the front end of the protruding left end part 71A. Similar to the first protruding piece F1, the second protruding piece F2 is also a protruding piece protruding leftward from the lower end of the protruding left end part 71A. Furthermore, the third protruding piece F3 and the fourth protruding piece F4 of the protruding right end part 71B are arranged so as to oppose to the first protruding piece F1 and the second protruding piece F2, respectively. The third protruding piece F3 and the fourth protruding piece F4 are protruding pieces protruding rightward from the lower end of the protruding right end part 71B. In fixing the main body protrusion 71 to the container insertion surface 901, the first protruding piece F1, the second protruding piece F2, the third protruding piece F3, and the fourth protruding piece F4 are inserted in respective openings (not shown) formed in the container insertion surface 901.

The main body protrusion 71 has a shape in which a plurality of plate members different from each other in length are adjacent to each other in the transverse direction and extend frontward from the front side surface of the protruding base end part 71C. Accordingly, the main body protrusion 71 includes an eleventh contact receiving part B1, a twelfth contact receiving part B2, a thirteenth contact receiving part B3, a fourteenth contact receiving part B4, and a fifteenth contact receiving part B5 (each being an opposing wall surface part). The five contact receiving parts are wall surfaces formed so as to face in the insertion direction of the toner container 900. In other words, the five contact receiving parts are arranged so as to face to the corresponding contact parts of the container protrusion 85 of the toner container 900 in the front-back direction. The five contact receiving parts are different in position in the front-back direction and in the transverse direction.

In other words, the order in which the contact receiving parts B 1-B5 are arranged in the front-back direction (the first direction) is different from the order in which the contact receiving parts B1-B5 are arranged in the transverse direction (the second direction) intersecting with the front-back direction. That is, the order in which the contact receiving parts B1-B5 are arranged when viewing the main body protrusion 71 in the transverse direction (the second direction) is different from the order in which the contact receiving parts B1-B5 are arranged when viewing the main body protrusion 71 in the front-back direction (the first direction) intersecting with the transverse direction. In the main body protrusion 71, the shape of an insertion space Z2, which is formed in front of the five contact receiving parts, corresponds to the protruding shape Z1 of the container protrusion 85. That is, the five contact receiving parts form the same arrangement pattern as the five contact parts of the container protrusion 85. Accordingly, when the toner container 900 is inserted to the container insertion surface 901, the container protrusion 85 is fitted in the main body protrusion 71.

The container protrusion 85 and the main body protrusion 71 with the above described shapes can prevent erroneous fitting of the toner container 900. The toner container 900 is inserted in the direction indicated by the arrow D11 in FIG. 11 to the main body protrusion 71 formed on the container insertion surface 901. In so doing, the container protrusion 85 of the toner container 900 is inserted in the direction indicated by the arrow D10 in FIG. 10. Then, when the toner container 900 is inserted up to the rear end of the container insertion surface 901, the eleventh contact part A1, the twelfth contact part A2, the thirteenth contact part A3, the fourteenth contact part A4, and the fifteenth contact part A 5 of the container protrusion 85 simultaneously come in contact with the eleventh contact receiving part B1, the twelfth contact receiving part B2, the thirteenth contact receiving part B3, the fourteenth contact receiving part B4, and the fifteenth contact receiving part B5 of the main body protrusion 71, respectively.

At this time, the rear end part 900R (FIG. 9) of the toner container 900 is entirely fitted to the rear end part 21R (FIG. 4) of the lower housing 21. Thus, the toner container 900 can be used in the image forming apparatus 1, and the toner in the toner container 900 can be supplied to the developing counter 10 through the toner ejection section 70 (FIG. 4).

Figure 12:
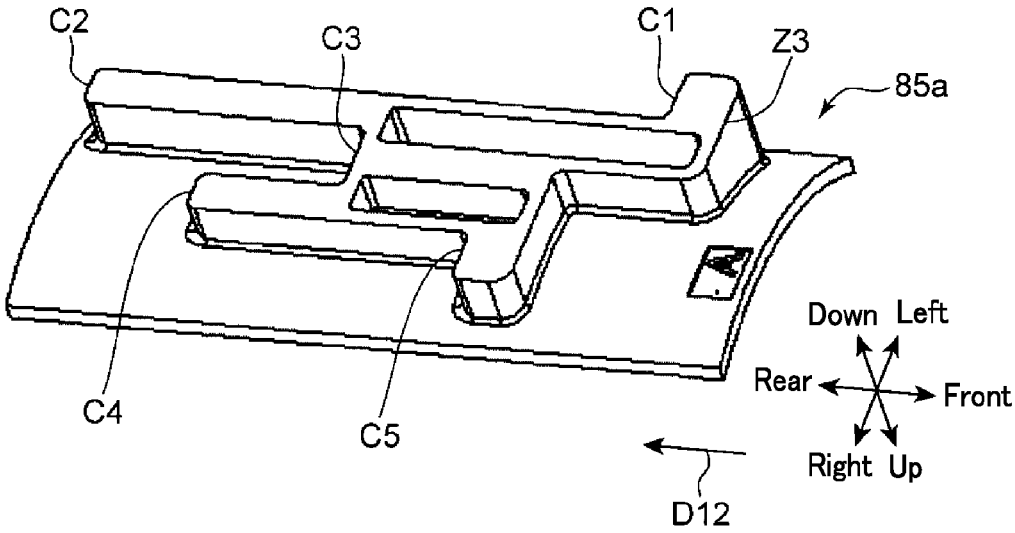
FIG. 12 is a perspective view of a container protrusion according to another embodiment of the present disclosure.
Figure 13:
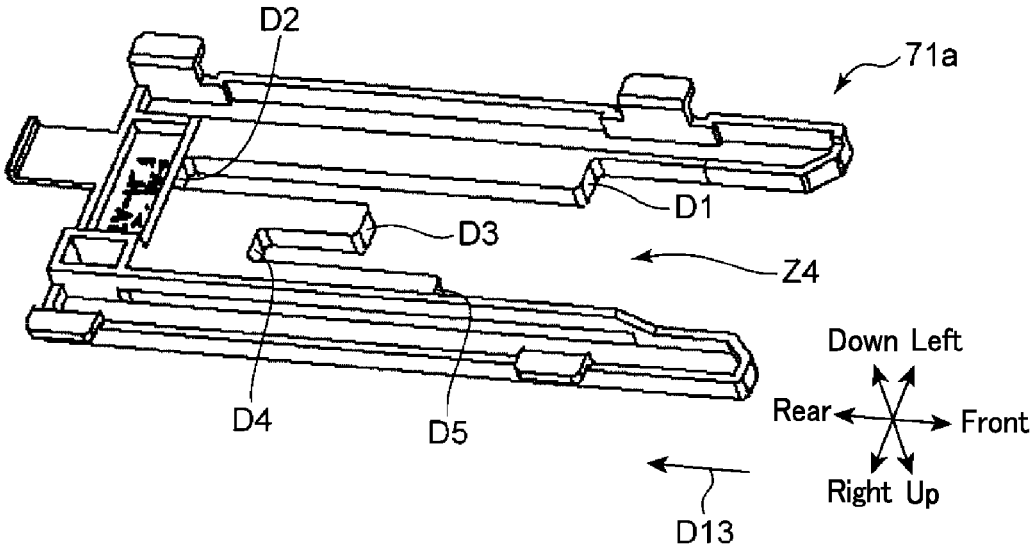
FIG. 13 is a perspective view of a main body protrusion according to another embodiment of the present disclosure.

FIGS. 12 and 13 are perspective views of a container protrusion 85*a* and a main body protrusion 71*a*, respectively. Both the container protrusion 85*a* and the main body protrusion 71*a* are used in combination likewise the container protrusion 85 and the main body protrusion 71. The container protrusion 85*a* includes a twenty-first contact part C1, a twenty-second contact part C2, a twenty-third contact part C3, a twenty-fourth contact part C4, and a twenty-fifth contact part C5.

On the other hand, the main body protrusion 71*a* includes a twenty-first contact receiving part D1, a twenty-second contact receiving part D2, a twenty-third contact receiving part D3, a twenty-fourth contact receiving part D4, and a twenty-fifth-contact part D5. A protruding shape Z3 that the container protrusion 85*a* has corresponds to an insertion space Z4 formed by the main body protrusion 71*a*. Then, when a toner container 900 with the container protrusion 85*a* is inserted to the container insertion surface 901 (the arrow D12 in FIG. 12 and the arrow D13 in FIG. 13), the twenty-first the contact part C1, the twenty-second contact part C2, the twenty-third contact part C3, the twenty-fourth contact part C4, and the twenty-fifth contact part C5 of the container protrusion 85*a* substantially simultaneously come in contact with the twenty-first contact receiving part D1, the twenty-second contact receiving part D2, the twenty-third contact receiving part D3, the twenty-fourth contact receiving part D4, and the twenty-fifth contact receiving part D5 of the main body protrusion 71*a*, respectively.

Figure 14:
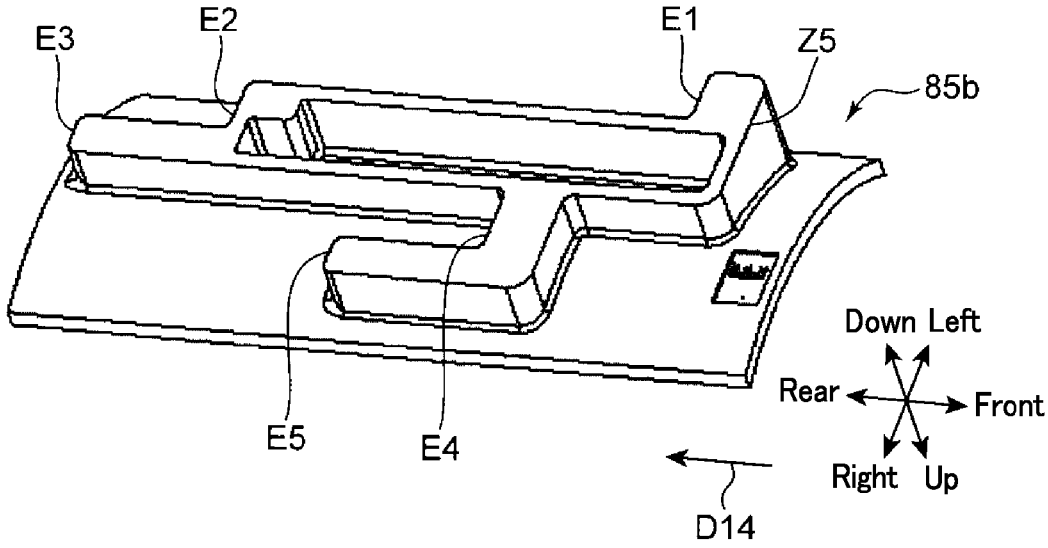
FIG. 14 is a perspective view of a container protrusion according to still another embodiment of the present disclosure.
Figure 15:
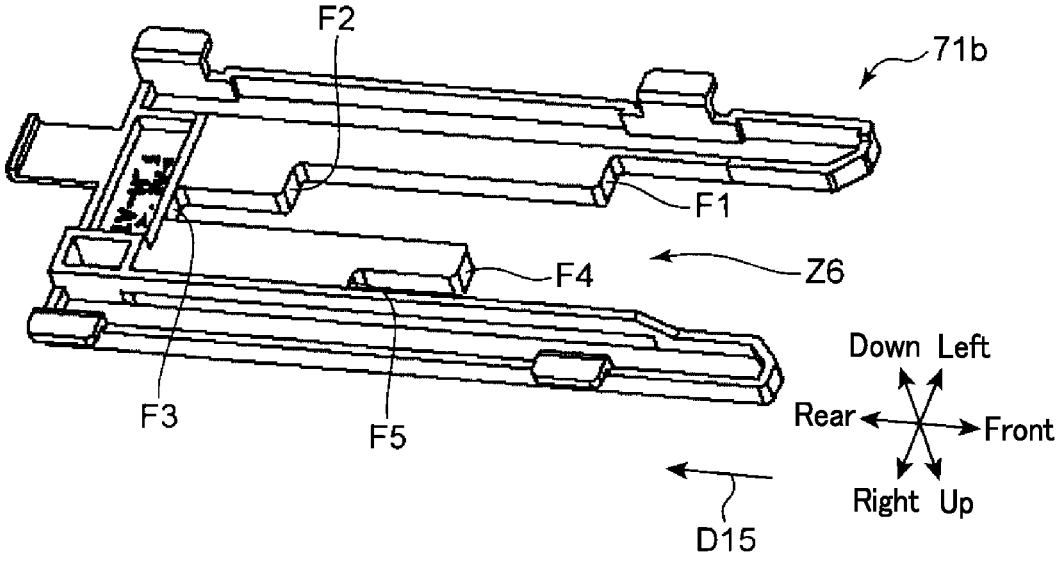
FIG. 15 is a perspective view of a main body protrusion according to yet another embodiment of the present disclosure.
Figure 16:
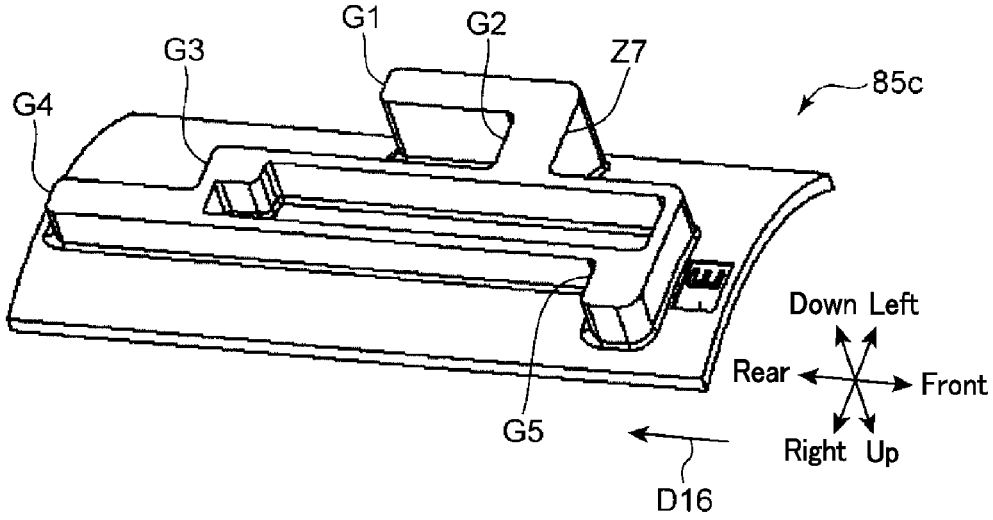
FIG. 16 is a perspective view of a container protrusion according to further another embodiment of the present disclosure.
Figure 17:
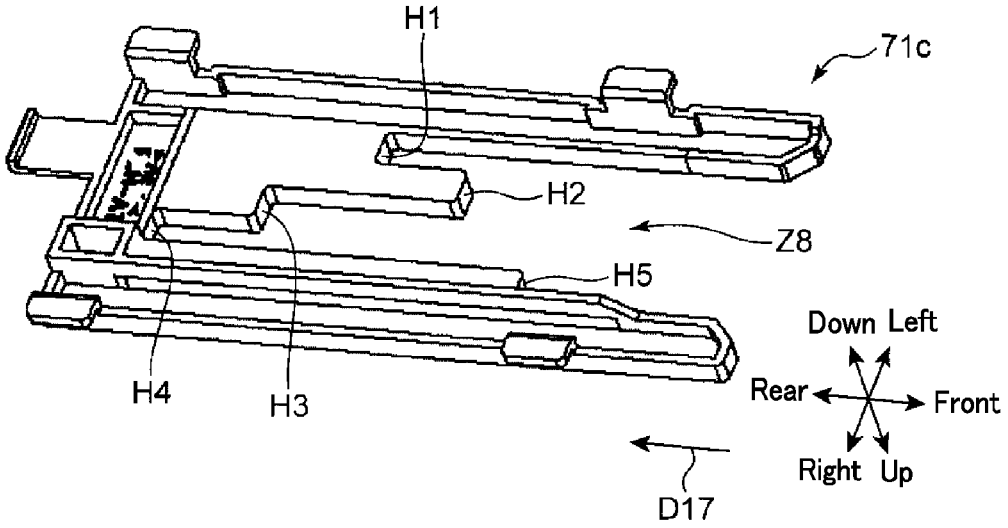
FIG. 17 is a perspective view of a main body protrusion according to still another embodiment of the present disclosure.

Similarly, FIGS. 14 and 15 are perspective views of a container protrusion 85*b* and a main body protrusion 71*b*, respectively. FIGS. 16 and 17 are perspective views of a container protrusion 85*c* and a main body protrusion 71*c*, respectively. In the combination of the container protrusion 85*b* and the main body protrusion 71*b* and the combination of the container protrusion 85*c* and the main body protrusion 71*c*, similarly to the above, the plural contact receiving parts substantially simultaneously come in contact with the plural contact parts in fitting the toner container 900.

It is noted that in FIG. 14, the protrusion 85*b* includes contact parts E1-E5 and has a protrusion shape Z5, and the arrow D14 indicates the insertion direction of the toner container 900. In FIG. 15, the main body protrusion 71*b* includes contact receiving parts F1-F5 and has an insertion space Z6, and the arrow D15 indicates the insertion direction of the toner container 900.

Further, in FIG. 16, the protrusion 85*c* includes contact parts G1-G5 and has a protruding shape Z7, and the arrow D16 indicates the insertion direction of the toner container 900. In FIG. 17, the main body protrusion 71*c* includes contact receiving parts H1-H5 and has an insertion space Z8, and the arrow D17 indicates the insertion direction of the toner container 900.

Here, the orders in which the five contact parts are arranged in the front-back direction are different among the container protrusion 85, 85*a*, 85*b*, and 85*c*.

Accordingly, when the arrangements of the five contact parts are set so as to differ according the specification of the toner container 900 and the specification of the image forming apparatus 1 to which the toner container 900 is fitted, the image quality can be maintained at high level in image formation by the image forming apparatus 1. Examples of the specification of the toner container 900 may include but are not limited to the color, grain size, material, etc. of the toner filled in the toner container 900. Further, examples of the specification of the image forming apparatus 1 may include but are not limited to the country where the image forming apparatus 1 is used, printing speed of the image forming apparatus 1, etc.

It is noted that the orders in which the five contact parts are arranged in the transverse direction may be different among the container protrusions 85, 85*a*, 85*b*, and 85*c* in addition to the orders in which the five parts are arranged in the front-back direction. Alternatively, only the orders in which the five contact parts are arranged in the transverse direction may be different among the container protrusions 85, 85*a*, 85*b*, and 85*c*.

Referring to one example, the toner container 900 with the container protrusion 85 is filled with magenta toner MT exhibiting normal chromogenic property. By contrast, a toner container 900 (hereinafter denoted by 900*a*) with the container protrusion 85*a* is filled with magenta toner MTH exhibiting chromogenic property that is brighter than that of the magenta toner MT. The main body protrusion 71 is provided in the image forming apparatus 1, which is capable of providing high image quality by setting in advance a preferable image condition for use of the magenta toner MT. On the other hand, the main body protrusion 71*a* is provided in another image forming apparatus 1 (hereinafter denoted by 1*a*), which is capable of providing high image quality similarly for use of the magenta toner MTH. Accordingly, when the toner container 900 is fitted in the image forming apparatus 1, the container protrusion 85 and the main body protrusion 71 fit together. On the other hand, when the toner container 900*a* is fitted in the image forming apparatus la, the container protrusion 85*a* and the main body protrusion 71*a* fit together. Thus, image quality can be maintained at high level in both the image forming apparatus 1 and the image forming apparatus la.

By contrast, if the toner container 900 is fitted in the image forming apparatus 1*a* in error, the image quality by the image forming apparatus 1*a* may degrade. However, the combination of the container protrusion 85 and the main body protrusion 71*a* can prevent the toner container 900 from being fitted to the image forming apparatus 1*a*. Because, the container protrusion 85 (FIG. 10) is formed on the toner container 900, while the main body protrusion 71*a* (FIG. 13) is formed on a container insertion surface 901*a* (not shown) of the image forming apparatus 1*a*.

When the toner container 900 is inserted along the container insertion surface 901*a*, the thirteenth contact part A3 of the container protrusion 85, which is located on the rearmost side, comes in contact with the twenty-third contact receiving part D3 of the main body protrusion 71*a*. Then, this contact can prevent further insertion of the container protrusion 85 (the toner container 900) rearward (backward) of the container insertion surface 901*a* (the image forming apparatus 1*a*). Thus, the toner container 900 is effectively prevented from being erroneously fitted into the image forming apparatus 1*a*. In sum, according to the present embodiment, the plural contact parts of the container protrusion 85 are arranged so that the order in which the contact parts are arranged in the front-back direction is different from the order in which the contact parts are arranged in the transverse direction. Further, in the present embodiment, the toner container 900 (the container protrusion 85) with the plural contact parts is capable of being fitted in and mating with the image forming apparatus 1 (the main body protrusion 71) with the plural contact receiving parts arranged correspondingly to the plural contact parts.

Figure 21:
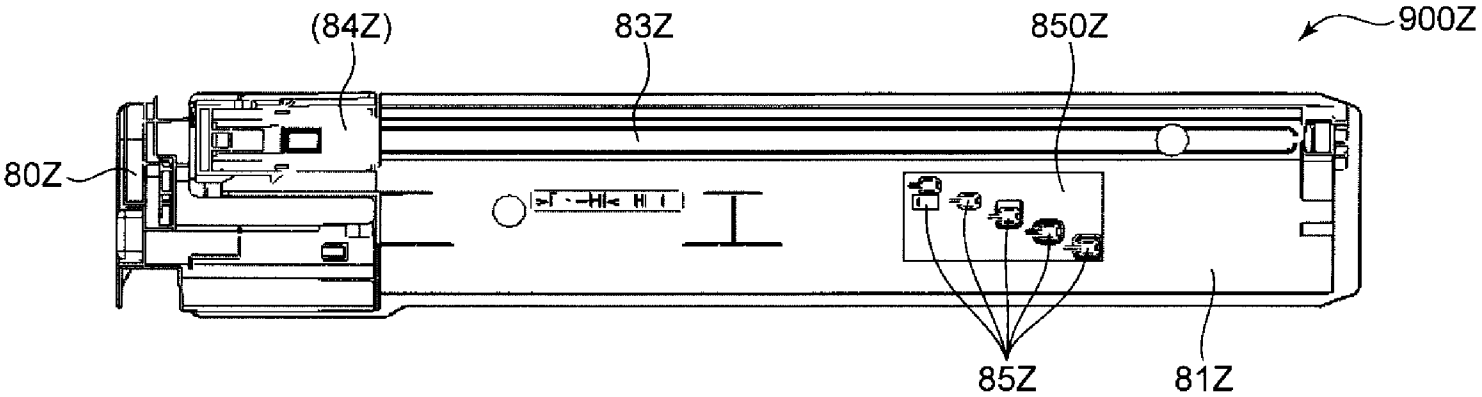
FIG. 21 is a bottom view of a toner container for comparison with the toner container according to one embodiment of the present disclosure.

Moreover, according to the present embodiment, the plural contact parts of the container protrusion 85 of the toner container 900 are connected together, thereby enabling exhibition of high rigidity. FIG. 21 is a bottom view of a toner container 900Z for comparison with that in the present embodiment. Five container protrusions 85Z are formed on a protrusion forming surface 850A so as to independently protrude from a main body part 81Z. With this configuration, if the toner container 900Z is fitted to a non-corresponding image forming apparatus 1 in error, one of the contact receiving parts of the main body protrusion 71 of the image forming apparatus 1 comes in hard contact with one of the container protrusions 85Z. This may results in breakage of the one of the container protrusions 85Z. Alternatively, such fitting may cause deformation of the container protrusions 85Z to allow the toner container 900Z to be fitted into the inside of the image forming apparatus 1 in error with strong operation force.

By contrast, according to the present embodiment, as described above, the container protrusion 85 has the integral protrusion shape that connects the plural contact parts together. In particular, the wall groups of the container protrusion 85 orthogonal to each other integrally form the plural contact parts. Accordingly, high rigidity of the container protrusion 85 can be maintained. As described above, when the toner container 900 with the container protrusion 85 (FIG. 10) is inserted along the container insertion surface 901*a* where the main body protrusion 71*a* (FIG. 13) is formed, the thirteenth contact part A3 of the container protrusion 85, which is located on the rearmost side, comes in contact with the twenty-third contact receiving part D3 of the main body protrusion 71*a*. At this time, the thirteenth contact part A3 receives force in the direction opposite to the direction of the arrow D10 in FIG. 10. However, since the thirteenth contact part A3 is supported by the third wall part 112, the fourth wall part 113, the sixth wall part 115, etc., the container protrusion 85 can be prevented from being broken partially. Further, the container protrusion 85 can be prevented from riding on the main body protrusion 71*a*, thereby effectively preventing the toner container 900 from being fitted to the image forming apparatus 1*a* in error.

Furthermore, in the present embodiment, as shown in FIG. 10, the container protrusion 85 protrudes on the protrusion forming surface 850 so as to form curved surfaces at corner areas where a plurality of wall parts intersect with the protrusion forming surface 850 (the outer wall of the main body part 81). It should be noted that, of all corner areas, corner areas where the contact parts intersect with the protrusion forming surface 850 (corner areas corresponding to the contact parts) have a curved surface larger than the other corner areas. Details are given as follows.

The container protrusion 85 includes a first corner area R1, a second corner area R2, a third corner area R3, a fourth corner area R4, a fifth corner area R5, and a sixth corner area R6. The first corner area R1 is a corner area where the thirteenth contact part A3 intersects with the protrusion forming surface 850. The second corner area R2 is a corner area where the fourteenth contact part A4 intersects with the protrusion forming surface 850. Further, the third corner area R3 is a corner area where the fifteenth contact part A5 intersects with the protrusion forming surface 850.

By contrast, the fourth corner area R4 is a corner area where the front surface of the ninth wall part 118 intersects with the protrusion forming surface 850. The fifth corner area R5 is a corner area where the front surface of the second wall part 111 intersects with the protrusion forming surface 850. The sixth corner area R6 is a corner area where the right side surface of the fourth wall part 113 intersects with the protrusion forming surface 850.

Referring to the above description, the first corner area R1, the second corner area R2, and the third corner area R3 are corner areas corresponding to the respective contact parts and each have a curved shape (round shape) with a radius of 1.5 mm. By contrast, the fourth corner area R4, the fifth corner area R5, and the sixth corner area R6 are the other corner areas each having a curved shape with a radius of 1 mm. Thus, the corner areas where the respective contact parts intersect with the protrusion forming surface 850 have large curved surfaces when compared to those of the other corner areas of the container protrusion 85. Accordingly, each contact part can have increased strength against the protrusion forming surface 850. Thus, breakage and deformation of each contact part can be effectively prevented.

Figure 18:
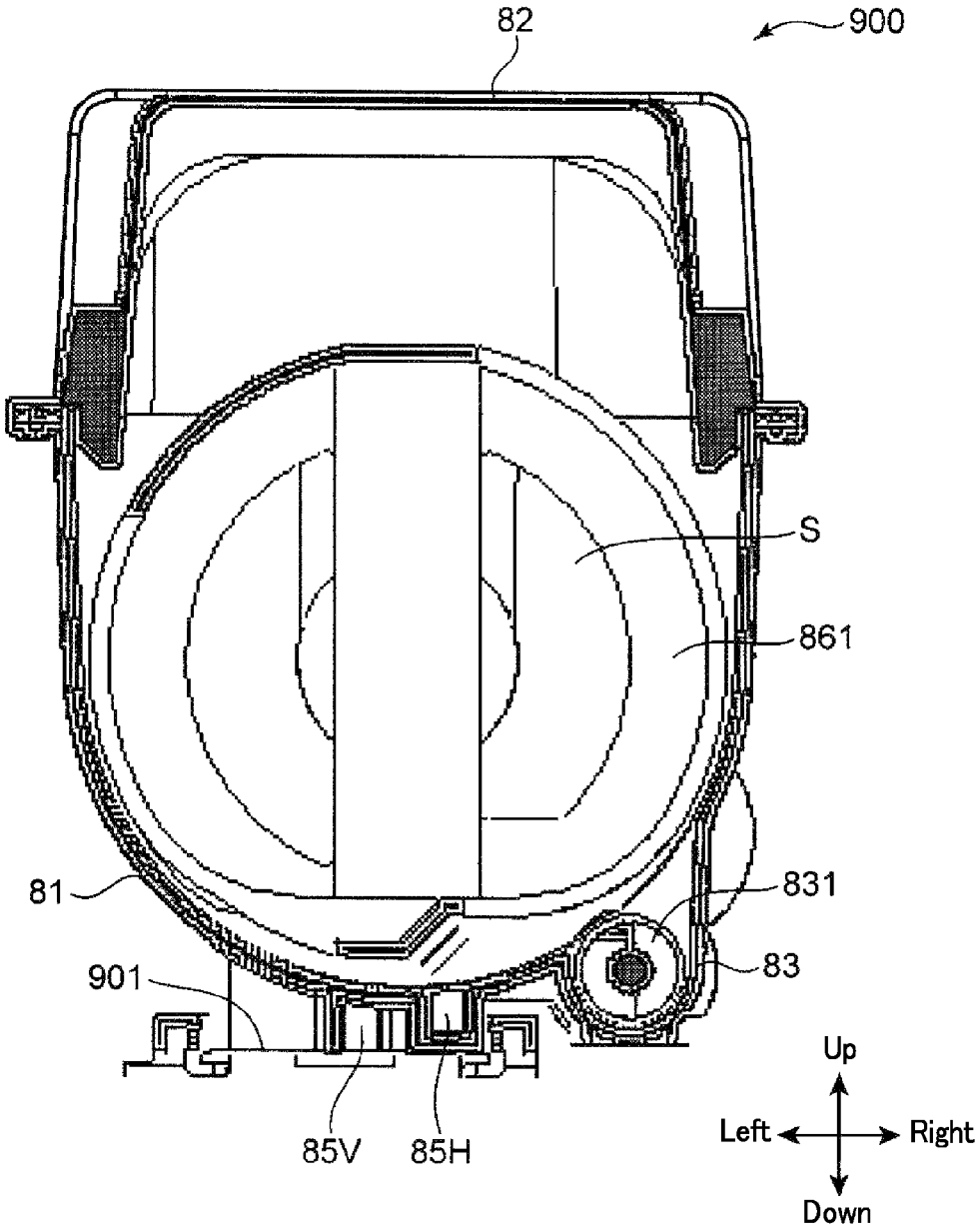
FIG. 18 is a cross sectional view of a toner container according to one embodiment of the present disclosure.
Figure 19:
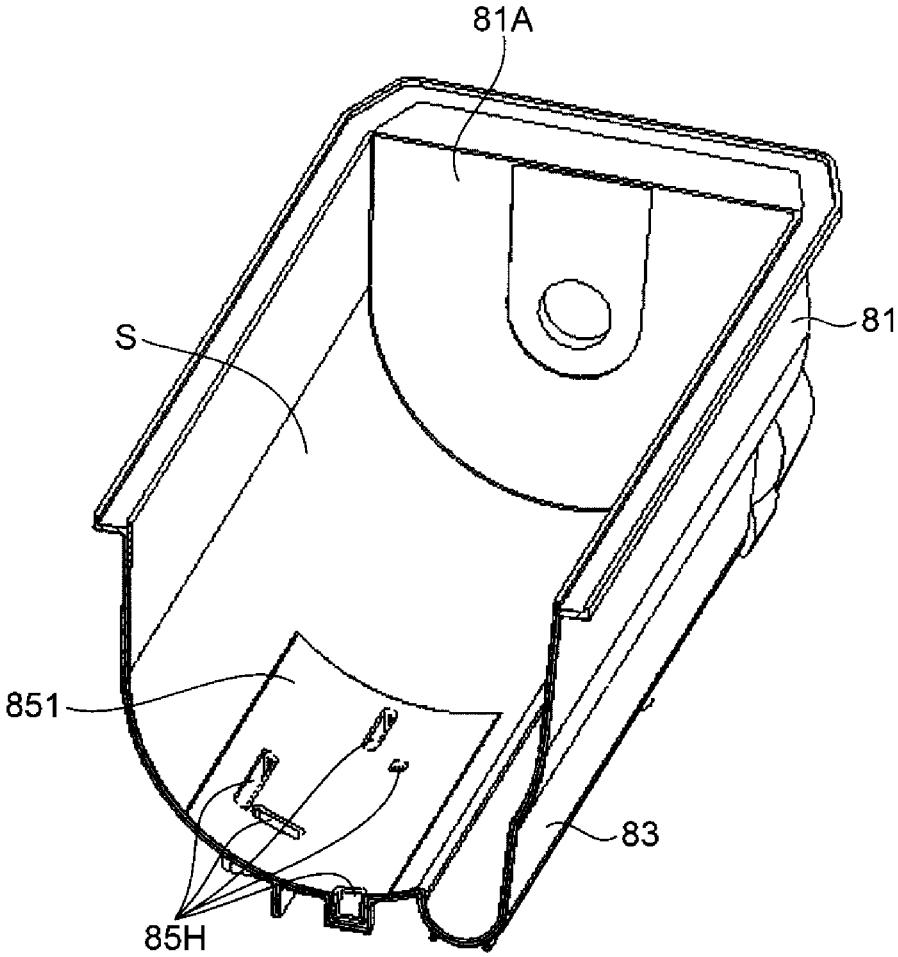
FIG. 19 is a cross-sectional perspective view showing part of the toner container according to one embodiment of the present disclosure.
Figure 20:
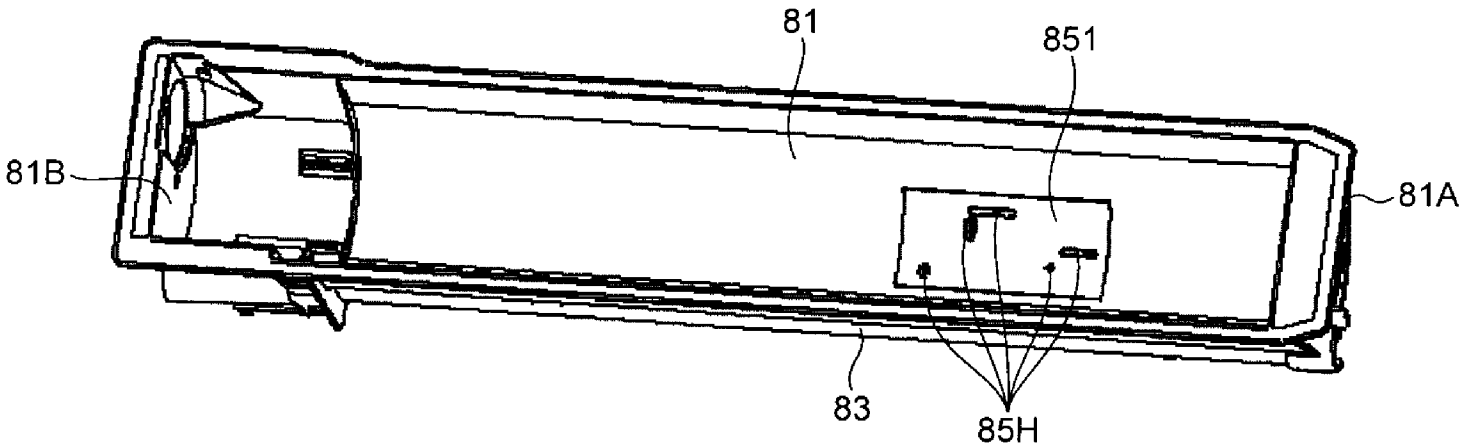
FIG. 20 is a perspective view showing the inside of the toner container according to one embodiment of the present disclosure.

Further, in the present embodiment, the shape of the container protrusion 85 can contribute to maintenance of the image quality of the image forming apparatus 1 to which the toner container 900 is fitted. FIG. 18 is a cross sectional view of the toner container 900. FIG. 19 is a cross-sectional perspective view showing part on the rear end side of the main body part 81 of the toner container 900. Further, FIG. 20 is a perspective view showing the inside of the toner container 900 as viewed from above.

In the present embodiment, inner recesses 85H (space) are formed on the reverse (inner) side of the container protrusion 85 in a protrusion reverse surface 851, which serves as the reverse surface of the protrusion forming surface 850. For example, the inner recesses 85H are formed on the reverse (inner) sides of the wall parts of the container protrusion 85 protruding from the protrusion forming surface 850. Referring to FIG. 19, for example, the inner recesses 85H are formed on the reverse (inner) sides of the first wall part 110, the second wall part 111, the third wall part 112, and the fifth wall part 114 of the container protrusion 85 in FIG. 10. The inner recesses 85H are formed inside the container protrusion 85 in a region outside the outer wall of the main body part 81. Further, the inner recesses 85H are a space communicating with the inner space S of the main body part 81. By contrast, as shown in FIG. 10, an outer recess 85V is formed between the fourth wall part 113 and the seventh wall part 116. In other words, the outer recess 85V is surrounded and defined by the fourth wall part 113, the third wall part 112, the sixth wall part 115, the fifth wall part 114, the seventh wall part 116, the eighth wall part 117, and the ninth wall part 118. Further, the outer recess 85V is open outward of the main body part 81.

The wall parts that define the outer recess 85V include the third wall part 112 and the fifth wall part 114 which have the corresponding inner recesses 85H. In other words, it can be said that the outer recess 85V defines the inner recesses 85H.

Here, the operator may forcibly fit the toner container 900, on which the container protrusion 85 is formed, into the image forming apparatus la, in which the main body protrusion 71*a* is formed. This operator's operation may scrape off the container protrusion 85 of the toner container 900. In this case, as described above, in the image forming apparatus 1*a*, preferable image quality cannot be obtained with the magenta toner MH filled in the toner container 900.

However, in this case, scraping off of the first wall part 110, the second wall part 111, the third wall part 112, and the fifth wall part 115 of the container protrusion 85 opens the inner recesses 85H to allow the inside and the outside of the toner container 900 to communicate with each other. This can cause the toner filled in the toner container 900 to leak outside through the inner recesses 85H. Accordingly, the operator can recognizes that the inappropriate toner container 900, of which the container protrusion 85 is scraped off, is fitted to the image forming apparatus 1*a*. Accordingly, the image forming apparatus 1*a* is prevented from forming an image with the magenta toner MH filled in the toner container 900.

In particular, as described above, in the present embodiment, the container protrusion 85 is formed integrally with the main body part 81 of the toner container 900. Specifically, in FIG. 18, in order to form the main body part 81 of the toner container 900, a mold for the main body part 81 is divided vertically. Accordingly, the outer recess 85V is formed with a lower die, while the inner recesses 85H are formed with an upper die.

In the above embodiments, the container protrusion 85 formed on the toner container 900 can effectively prevent the toner container 900 from being fitted erroneously in the image forming apparatus 1. Combination of the container protrusion 85 with the main body protrusion 71 formed in the image forming apparatus 1 enables fitting of the toner containers 900 having different specifications to image forming apparatuses 1 in appropriate combination. In particular, the arrangements of the plural contact parts of the container protrusion 85 and the plural contact receiving parts of the main body protrusion 71 are made differ. This can provide the toner containers 900 that meet different specifications. In the arrangements, the plural contact parts on the container protrusion 85 are formed integrally so as to be connected together by the wall parts, thereby increasing the rigidity of them. Thus, even in fitting in erroneous combination of an image forming apparatus 1 and a toner container 900, the plural contact parts formed on the container protrusion 85 can be prevented from being broken and deformed.

It is noted that the present disclosure is not limited to the above embodiments and can employ any of the following modifications, for example.

(1) The above embodiments describe but do not limit the arrangement in which the five contact parts and the five contact receiving parts corresponding to the contact parts are arranged in the container protrusion 85 and the main body protrusion 71, respectively. The number of each of the contact parts and the contact receiving parts is not limited as far as it is plural.

(2) Further, the above embodiments describe but do not limit the arrangement in which the container protrusion 85 is formed on the lower surface of the toner container 900. The container protrusion 85 may be formed on the upper surface or the side surface of the toner container 900. Further, the container protrusion 85 may be formed on the rear wall surface of the toner container 900. In these cases, the main body protrusion 71 is formed at a location facing the container protrusion 85 inside the image forming apparatus 1 correspondingly to the arrangement of the container protrusion 85.

(3) Furthermore, the above embodiments describe but do not limit the toner container 900 as a unit with the container protrusion 85 which is configured to be fitted in the image forming apparatus 1. A protrusion similar to the container protrusion 85 may be formed on each developer housing 20. Even in this case, the main body protrusion 71 formed in the image forming apparatus 1 can be fitted to the protrusion formed on the developer housing 20, thereby effectively preventing a developer housing 20 having a different specification from being fitted erroneously to the image forming apparatus 1. In addition, protrusions similar to the container protrusion 85 may be formed on image forming units with the developer housings 20 of the respective colors. In this case, the protrusions similar to the main body protrusion 71 are formed on the developer housings 20.

Thus, the toner containers 900 function as developer containers configured to be filled with the developer. The developer is also filled in the developer housings 20. Accordingly, the developer housings 20 function as developer containers also.

(4) The above embodiments describe the corner areas R1-R6 having curved surfaces. However, the shapes of the corner areas R1-R6 are not limited to the curved shape but may be flat, for example.

(5) As described above, the contact parts (the wall surface parts) A1-A5 are flat surfaces orthogonal to the insertion direction of the toner container 900 (the front-back direction). The contact receiving parts (opposing wall surface parts) B1-B5 are also flat surfaces orthogonal to the insertion direction of the toner container 900 (the front-back direction). Accordingly, in fitting the toner container 900, the contact parts come in face contact with the contact receiving parts. This means that impact per unit area applied to the contact parts in fitting the toner container 900 is small when compared with that in point contact and in line contact. This can contribute also to prevention of breakage and deformation of the contact parts.

What is claimed is:

1. A developer container, which is to be fitted in a first direction to an image forming apparatus for forming an image on a sheet, comprising:

a main body having an outer wall and an inner space filled with a developer;

an opening which is opened in a rear of a central part of the outer wall of the main body in the first direction and from which the developer filled in the inner space falls; and a protrusion located in front of the central part of the outer wall of the main body in the first direction and protruding outward from the outer wall of the main body, wherein the protrusion includes a plurality of wall parts, each of the wall parts includes, at a front end of the wall part in the first direction, a wall surface part extending in a second direction which is in orthogonal to said first direction, the wall surface parts of the wall parts are ordered as a first order from a wall surface part located at a front end part in the first direction among the wall surface parts to a wall surface part located at a rear end part in the first direction among the wall surface parts, and ordered as a second order from a wall surface part located at a front end part in the second direction among the wall surface parts to a wall surface part located at a rear end part in the second direction among the wall surface parts, the first order being different from the second order, and the plurality of wall parts are formed integrally to connect the plurality of wall surface parts through the plurality of wall parts.

2. The developer container of claim 1, wherein
the plurality of wall surface parts are arranged adjacent to each other when viewed in the first direction.

3. The developer container of claim 1, wherein
some of the plurality of wall parts are arranged in the first direction to form a first wall group, and
the other of the plurality of wall parts are arranged in the second direction to form a second wall group.

4. The developer container of claim 1, wherein
of a plurality of corner areas where the plurality of wall parts intersect with the outer wall of the main body, a corner area where a wall surface part of the plurality of wall surface parts intersects with the outer wall has a curved shape larger than the other corner areas.

5. The developer container of claim 1, wherein
a space is formed inside the protrusion, and
the space communicates with the inner space of the main body.

6. The developer container of claim 5, wherein
the space is formed inside a wall part of the wall parts.

7. The developer container of claim 6, wherein
the wall part in which the space is formed is a wall part of the plurality of wall parts, which includes a wall surface part of the plurality of wall surface parts.

8. The developer container of claim 1, wherein
the protrusion has a recess defined by a part of the wall parts among the plurality of wall parts,
a space is formed inside a part of the part of the wall parts that defines the recess among the plurality of wall part, and
the space communicates with the inner space of the main body.

9. The developer container of claim 1, wherein
the protrusion has a recess defined by a part of the wall parts among the plurality of wall parts.

10. The developer container of claim 1, wherein
each of the wall surface parts includes a flat surface orthogonal to the first direction.

11. The developer container of claim 1, wherein
the protrusion is formed on a lower surface of the main body.

12. The developer container of claim 11, wherein
the protrusion is formed on part of the main body, which is closer to one of end parts of the main body than the other end part, and
the one of the end parts of the main body is inserted earlier than the other end part in fitting the developer container into the image forming apparatus.

13. The developing device of claim 1, wherein
with reference to the wall surface part located at the front end part in the first direction among the wall surface parts, at least one of the plurality of wall surface parts is located on one side of the protrusion in the second direction and at least another one of the plurality of wall surface parts is located on another side of the protrusion in the second direction.

14. A developing device, comprising:
a developer container configured to be filled with a developer;
a fitting part to which the developer container is fitted in a first direction; and
a developer housing to which the developer is supplemented,
wherein the developer container includes:
a main body having an outer wall and an inner space filled with a developer;
an opening which is opened in a rear of a central part of the outer wall of the main body in the first direction and from which the developer filled in the inner space falls; and
a protrusion located in front of the central part of the outer wall of the main body in the first direction and protruding outward from the outer wall of the main body,
the protrusion includes a plurality of wall parts,
each of the wall parts includes, at a front end of the wall part in the first direction, a wall surface part extending in the second direction,
the wall surface parts of the wall parts are ordered as a first order from a wall surface part located at a front end part in the first direction among the wall surface parts to a wall surface part located at a rear end part in the first direction among the wall surface parts, and ordered as a second order from a wall surface part located at a front end part in the second direction among the wall surface parts to a wall surface part located at a rear end part in the second direction among the wall surface parts, the first order being different from the second order, and
the plurality of wall parts are formed integrally to connect the plurality of wall surface parts through the plurality of wall parts,
the fitting part includes an opposing member to which the protrusion of the developer container is fitted when the developer container is fitted in the first direction,
the opposing member includes a plurality of opposing wall surface parts configured to face to the plurality of wall surface parts of the protrusion in the first direction, and
the plurality of opposing wall surface parts of the opposing member has an arrangement pattern, which is the same as an arrangement pattern of the plurality of wall surface parts of the protrusion.

15. An image forming apparatus, comprising:
the developing device of claim 14;
an image carrier configured to carry a developer image obtained by visualizing a latent image formed on a peripheral surface of the image carrier with developer supplied from the developing device; and
a transfer section configured to transfer the developer image from the image carrier to a sheet.

* * * * *